US007587157B2

(12) United States Patent
Matsuda et al.

(10) Patent No.: US 7,587,157 B2
(45) Date of Patent: Sep. 8, 2009

(54) IMAGE FORMING APPARATUS CAPABLE OF CORRECTING A ROTATION SPEED OF AN IMAGE CARRIER

(75) Inventors: Hiromichi Matsuda, Kanagawa-ken (JP); Hiroshi Koide, Kanagawa-ken (JP); Joh Ebara, Kanagawa-ken (JP); Toshiyuki Andoh, Kanagawa-ken (JP); Yasuhisa Ehara, Kanagawa-ken (JP); Kazuhiko Kobayashi, Tokyo (JP); Yuji Matsuda, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 148 days.

(21) Appl. No.: 11/627,205

(22) Filed: Jan. 25, 2007

(65) Prior Publication Data

US 2007/0172257 A1 Jul. 26, 2007

(30) Foreign Application Priority Data

Jan. 25, 2006 (JP) ..... 2006-015825

(51) Int. Cl.
*G03G 15/14* (2006.01)

(52) U.S. Cl. ..... 399/301; 399/167; 399/49; 399/308; 399/299

(58) Field of Classification Search ..... 399/301, 399/49; 347/116
See application file for complete search history.

(56) References Cited

U.S. PATENT DOCUMENTS 5,287,162 A * 2/1994 de Jong et al. ..... 399/49
5,317,602 A * 5/1994 Onoda et al.
5,499,092 A * 3/1996 Sasaki ..... 399/302
5,995,802 A * 11/1999 Mori et al. ..... 399/394
6,038,423 A * 3/2000 Tagawa et al. ..... 399/301
6,201,943 B1 * 3/2001 Asakura et al. ..... 399/297
6,873,346 B2 * 3/2005 Bannai ..... 347/116
6,876,821 B2 * 4/2005 Ishii et al. ..... 399/49
6,938,351 B2 * 9/2005 Kobayashi et al. ..... 399/313
7,012,628 B2 * 3/2006 Masuda ..... 347/116

(Continued)

FOREIGN PATENT DOCUMENTS

JP 10-078734 3/1998

(Continued)

*Primary Examiner*—David M Gray
*Assistant Examiner*—G. M. Hyder
(74) *Attorney, Agent, or Firm*—Oblon, Spivak, McClelland, Maier & Neustadt, P.C.

(57) ABSTRACT

An image forming apparatus includes a latent image carrier having a moving surface on which a latent image is formed, a drive control mechanism to control a drive of the latent image carrier so as to match a rotation angular speed of the latent image carrier with a target rotation angular speed thereof, a surface moving member having a moving surface on which an adjustment pattern for use in controlling the drive of the latent image carrier is formed, an image forming mechanism to develop the latent image with toner and transfer a resultant toner image on the surface moving member so as to form the adjustment pattern along a surface moving direction thereof, a pattern sensor to detect the adjustment pattern, a correction mechanism to correct the target rotation angular speed of the latent image carrier based on an amplitude and a phase of a variable component in a pattern interval of the adjustment pattern detected with the pattern sensor.

10 Claims, 10 Drawing Sheets

U.S. PATENT DOCUMENTS

| | | | | |
|---|---|---|---|---|
| 7,245,862 | B2 * | 7/2007 | Ebara | 399/299 |
| 2003/0021613 | A1 * | 1/2003 | Koide | 399/167 |
| 2003/0210932 | A1 * | 11/2003 | Koide et al. | 399/302 |
| 2005/0238388 | A1 * | 10/2005 | Tanaka | 399/167 |
| 2006/0222418 | A1 * | 10/2006 | Ebara et al. | 399/301 |

FOREIGN PATENT DOCUMENTS

| | | | | |
|---|---|---|---|---|
| JP | 2003-066660 | | | 3/2003 |
| JP | 2004101655 | A | * | 4/2004 |
| JP | 2005-202432 | | | 7/2005 |
| JP | 2006293179 | A | * | 10/2006 |

* cited by examiner

IMAGE FORMING APPARATUS CAPABLE OF CORRECTING A ROTATION SPEED OF AN IMAGE CARRIER

CROSS REFERENCE TO RELATED APPLICATIONS

This patent specification is based on Japanese patent application, No. JP2006-015825 filed on Jan. 25, 2006 in the Japan Patent Office, the entire contents of which are incorporated by reference herein.

BACKGROUND OF THE INVENTION

1. Field of the Invention

The present invention relates to an image forming apparatus, and more particularly to an image forming apparatus capable of forming a quality color image by effectively correcting a variation in surface moving speed of a surface moving member.

2. Discussion of the Background

Image forming apparatuses include copiers, printers, facsimiles, multi-function devices thereof, etc. Some image forming apparatuses form a color image on a recording member according to an electrophotographic method. Such image forming apparatuses optically write a latent image on an image carrier, develop the latent image with toner, transfer the toner image onto a recording member carried on a surface moving member to obtain a color image.

Alternatively, such image forming apparatuses optically write a latent image on a surface moving member, develop the latent image with toner, temporarily transfer the toner image onto a surface moving member and then transfer the toner image onto a recording member carried on another surface moving member to obtain a color image.

In recent years, high image quality and high speed processing have been increasingly demanded for the above image forming apparatuses. The image forming apparatuses capable of meeting such demands include a tandem-type image forming apparatus employing a direct transfer method.

For example, a tandem-type image forming apparatus employing a direct transfer method forms single-color toner images of black, yellow, magenta, and cyan on photoconductive drums for black, yellow, magenta, and cyan, respectively. Then, the tandem-type image forming apparatus superimposingly transfers the single-color toner images onto a recording member carried on a conveyor belt.

However, this tandem-type image forming apparatus employing the direct transfer method may cause a noticeable color misregistration. The color misregistration is caused by a relative displacement in transfer position between the single-color toner images formed on the recording member. Further, the color misregistration may cause bleeding between line images to be precisely superimposed on each other, or a white spot around a black-color character on a multi-color background. The color misregistration may also cause banding, that is, periodic band-shaped unevenness in toner density on a color background.

In addition, the image forming apparatuses capable of meeting such demands include a tandem-type image forming apparatus employing an intermediate transfer method. For example, a tandem-type image forming apparatus employing an intermediate transfer method forms single-color toner images of black, yellow, magenta, and cyan on photoconductive drums for black, yellow, magenta, and cyan, respectively. Then, the tandem-type image forming apparatus superimposingly transfers the single-color toner images on an intermediate transfer belt. Then, the tandem-type image forming apparatus transfers a resultant color image onto a recording member.

However, this tandem-type image forming apparatus employing the intermediate transfer method may also cause a noticeable color misregistration similar to the tandem-type image forming apparatus employing the direct transfer method. The color misregistration may be caused by a relative displacement in transfer position between the single-color toner images formed on the intermediate transfer belt.

The color misregistration is also caused mainly by a relative displacement in transfer position between single-color toner images formed on each of the photoconductive drums. Further, the relative displacement in transfer position between single-color toner images formed on each of the photoconductive drums is caused by a periodic variation in surface moving speed of each of the photoconductive drums.

Furthermore, the periodic variation in surface moving speed of each of the photoconductive drums may be significantly influenced by a variation in rotation angular speed of a rotation drive force transmitted to each of the photoconductive drums. The variation in rotation angular speed may be caused by a transmission error due to gear eccentricity or accumulated gear pitch error of a drive transmission system provided at a shaft of the photoconductive drum. The variation in rotation angular speed may also be caused by a transmission error due to shaft inclination or misalignment of a coupling member to allow the photoconductive drum to be attached to and detached from the drive transmission system.

Some of the image forming apparatuses are capable of correcting the color misregistration by suppressing the periodic variation in surface moving speed of the photoconductive drum. For example, an image forming apparatus detects a periodic variation in surface moving speed of each of a plurality of photoconductive drums. Based on a detection result of the periodic variation, the image forming apparatus finely adjusts a rotation angular speed of each of the plurality of photoconductive drums so as to suppress the periodic variation.

Specifically, a single-color adjustment pattern having a plurality of toner images is formed on each of the photoconductive drums for black, yellow, cyan, and magenta. The single-color adjustment pattern formed on each of the photoconductive drums is transferred onto an intermediate transfer belt so as to be arranged in an order of black, yellow, cyan, and magenta toner images. Then, the resultant multi-color adjustment pattern is sequentially sensed with a pattern sensor in the order of black, yellow, cyan, and magenta toner images. From signals sensed with the pattern sensor, a periodic variation component in surface moving speed having a rotation period of the photoconductive drum are detected as detection data.

Based on the detection data, a rotation angular speed of each of the photoconductive drums is finely adjusted so as to suppress the periodic variation in surface moving speed thereof. At this time, the image forming apparatus performs the fine adjustment of rotation angular speed of each of the photoconductive drums in a manner as follows.

The above detection data is based on a detection result of the adjustment pattern formed on the intermediate transfer belt while being influenced by the following two variations. The first variation is a variation in surface moving speed of the photoconductive drum at a time when a latent image is written onto the photoconductive drum to form the adjustment pattern. The second variation is a variation in surface moving speed of the photoconductive drum at a time when the adjustment pattern obtained by developing the latent image is transferred onto the intermediate transfer belt.

In addition, this image forming apparatus is configured to have a phase difference angle of substantially 180° between a latent-image writing position and a transfer position on the photoconductive drum. Specifically, the phase difference angle is formed with two imaginary lines connecting a rotation center of the photoconductive drum to each of the latent-image writing position and the transfer position on the surface thereof on an imaginary plane perpendicular to a rotation axis of the photoconductive drum.

Accordingly, a correction value is obtained by adding up a half gain to the detection data and inverting a phase thereof. Further, the correction value is superposed on an uncorrected target value of the rotation angular speed of the photoconductive drum. Then, drive of the photoconductive drum is controlled according to the corrected target value so as to suppress the periodic variation in surface moving speed of the photoconductive drum having a rotation period thereof.

However, as described above, the image forming apparatus is configured to have a phase difference angle of substantially 180° between the latent-image writing position and the transfer position on the photoconductive drum. If the image forming apparatus is configured to have a phase difference angle significantly deviated from 180°, an inaccurate correction value may be obtained, thereby causing an error in drive control of the photoconductive drum. Consequently, some limitation may be imposed on the layout of units in the image forming apparatus.

For the above reasons, demand is increasing for an image forming apparatus capable of effectively correcting the periodic variation in surface moving speed of the photoconductive drum with less limitation to the phase difference angle.

SUMMARY OF THE INVENTION

This patent specification describes an image forming apparatus which can form a quality color image by effectively correcting a variation in surface moving speed of a surface moving member. In one example, an image forming apparatus includes a latent image carrier, a drive control mechanism, a surface moving member, an image forming mechanism, a pattern sensor, and a correction mechanism. The latent image carrier is configured to have a moving surface on which a latent image is formed. The drive control mechanism is configured to control a drive of the latent image carrier so as to match a rotation angular speed of the latent image carrier with a target rotation angular speed thereof. The surface moving member is configured to have a moving surface on which an adjustment pattern for use in controlling the drive of the latent image carrier is formed. The image forming mechanism is configured to develop the latent image with toner and transfer a resultant toner image on the moving surface of the surface moving member so as to form the adjustment pattern along a surface moving direction thereof. The pattern sensor is configured to detect the adjustment pattern. The correction mechanism is configured to correct the target rotation angular speed of the latent image carrier based on an amplitude and a phase of a variable component in a pattern interval of the adjustment pattern detected with the pattern sensor.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
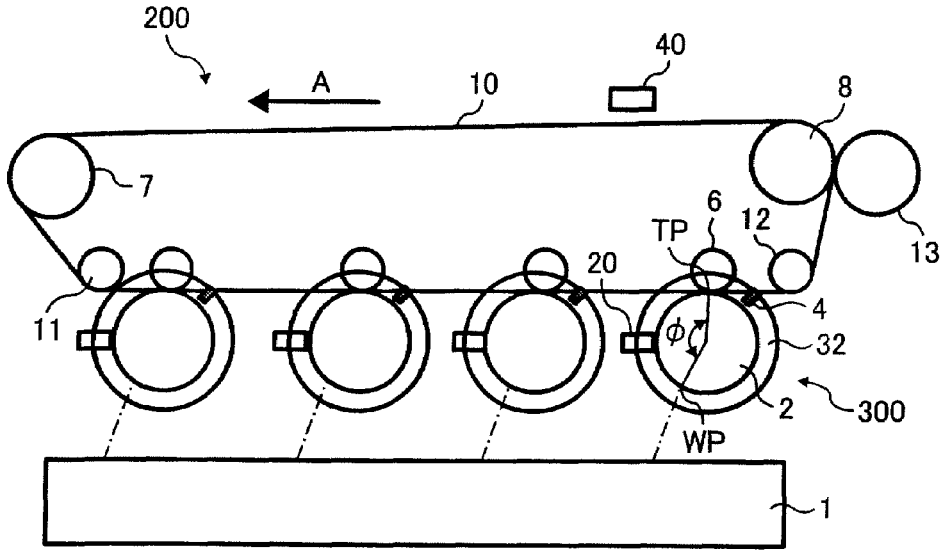
FIG. 1 is a diagram illustrating a schematic configuration of an image forming apparatus according to an example embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 200 according to an example embodiment of the present invention is described.

As illustrated in FIG. 1, the image forming apparatus 200 includes an intermediate transfer belt 10, support rollers 7, 8, 11, and 12, image forming mechanisms 300, a pattern sensor 40, an optical writing unit 1, a secondary transfer roller 13.

According to the present example embodiment, the image forming apparatus 200 is provided with the intermediate transfer belt 10 having a endless shape and serving as a surface moving member. The intermediate transfer belt 10 is looped over the support rollers 7, 8, 11, and 12. The intermediate transfer belt has a surface moved in a counterclockwise direction indicated by an arrow A in FIG. 1. In the present example embodiment, the support roller 8 is a drive roller (hereinafter, "drive support roller 8").

The image forming apparatus 200 also includes an un-illustrated cleaner to remove extra toner remaining on the intermediate transfer belt 10 after image formation. The un-illustrated cleaner is provided at a left side of the support roller 7 in FIG. 1.

The image forming mechanisms 300 are arranged along a downward surface of the intermediate transfer belt 10 stretched between the support roller 11 and the support roller 12. The image forming mechanisms 300 forms color images of yellow, cyan, magenta, and black.

Each of the image forming mechanisms 300 has a photoconductive drum 2, a drum drive gear 32, a bias roller 6, and a drum position sensor 20 as illustrated in FIG. 1.

The photoconductive drum 2 serves as a latent image carrier and is rotationally driven in a clockwise direction in FIG. 1. The photoconductive drum 2 are surrounded with the unillustrated devices, such as a charger, a developer, and a cleaner.

The image forming mechanisms 300 have a similar configuration except for difference in toner color. The bias roller 6 is arranged at a position opposite to the photoconductive drum 2 via the intermediate transfer belt 10. The intermediate transfer belt 10 is contacted to each of the photoconductive drums 2 with a corresponding one of the bias rollers 6.

Each of the drum drive gears 32 has a marking 4. The marking 4 is detected with a corresponding one of the drum position sensors 20. A rotation position of each of the photoconductive drums 2 can be determined based on a detection result by the corresponding one of the drum position sensors 20.

In the image forming apparatus 200, further, the pattern sensor 40 is provided at a position opposite to a surface of the intermediate transfer belt 10. The pattern sensor 40 detects an adjustment pattern formed on the surface of the intermediate transfer belt 10. In the present example embodiment, the two pattern sensors 40 are arrayed along an orthogonal direction (i.e. "belt-width direction") to the surface moving direction of the intermediate transfer belt 10.

Incidentally, the number of the pattern sensors 40 to be used is not limited to two. An increased number of the pattern sensors 40 may provide higher accuracy in detecting the adjustment pattern, a reduced time for the detecting operation, and higher accuracy in detecting a displacement in a main scanning direction of the intermediate transfer belt 10.

For example, when the number of the pattern sensors 40 is increased up to four, toner images of an adjustment pattern similar in color and shape are detected with the four pattern sensors 40. Therefore, higher accuracy may be obtained in detecting the adjustment pattern.

Furthermore, each of the four pattern sensors 40 detects a corresponding single-color adjustment pattern. Therefore, the adjustment pattern of four color toner images can be detected in a single operation, thereby reducing a time for the detecting operation.

Moreover, detection data are obtained from four points in the belt-width direction. Therefore, a positional displacement in the main scanning direction can also be detected.

In the image forming apparatus 200, further, the optical writing unit 1 is provided under the image forming mechanisms 300. The optical writing unit 1 optically writes an image on the surface of the photoconductive drum 2.

Furthermore, the secondary transfer roller 13 serving as a secondary transfer mechanism is arranged at a position opposite to the drive support roller 8 via the intermediate transfer belt 10. The secondary transfer roller 13 is in contact with the intermediate transfer belt 10 so as to be pressed toward the drive support roller 8.

A recording sheet is conveyed at a given timing from a lower part in FIG. 1 to a nip area (i.e. a secondary transfer area) between the secondary transfer roller 13 and the intermediate transfer belt 10. Then, a color image formed on the surface of the intermediate transfer belt 10 is transferred onto the recording sheet with the secondary transfer roller 13. Incidentally, the secondary transfer mechanism may include a transfer belt or a non-contact charger.

In the image forming apparatus 200, an un-illustrated fuser is provided above the secondary transfer roller 13 in FIG. 1. The un-illustrated fuser fuses and fixes a color image transferred on the recording sheet.

Next, an image forming operation of the image forming apparatus 200 is described.

When the image forming apparatus 200 is used as a copier, a document is set onto a document plate of an automatic document feeder (not illustrated) provided in an upper part of the image forming apparatus 200. Alternatively, the document is set onto a contact glass of a scanning part provided under the automatic document feeder.

When the document is set onto the automatic document feeder, on pressing an un-illustrated start button, the document is fed to the contact glass and then a scanning unit of the scanning portion is driven.

Alternatively, when the document is set onto the contact glass, on pressing the un-illustrated start button, the scanning unit of the scanning portion is driven.

On the start of a scanning operation of the scanning unit, the document is illuminated with light from a light source. A reflected light of the document is received at a sensor via an imaging lens. Thereby, the content of the document is converted to image data. Then, the following image forming operation is performed with the image data.

In addition, when the image forming apparatus 200 is used as a printer, the image forming apparatus 200 performs the following image forming operation with image data received from an external device, such as a computer or a digital camera.

In parallel with the scanning processing of the document and the receiving processing of the image data, the drive support roller 8 is driven with an un-illustrated drive motor. Thereby, the surface of the intermediate transfer belt 10 is moved in the counterclockwise direction indicated by the arrow A in FIG. 1. The other support rollers are rotated in conjunction with the surface moving.

At this time, in the image forming mechanisms 300, the photoconductive drums 2 are started to be driven. Then, the optical writing unit 1 emits a light beam to form a latent image on each of the photoconductive drums 2 according to color information of the image data. The latent image is developed with the developer in each of the image forming mechanisms 300. Thus, a single-color toner image is formed on each of the photoconductive drums 2.

Further, the single-color toner image in each of the photoconductive drums 2 is superimposingly transferred onto the intermediate transfer belt 10 so as to form a composite color image on the intermediate transfer belt 10.

In parallel with the above-described image forming operation, a recording sheet is conveyed to the secondary transfer area at a given timing. Specifically, the recording sheet is picked up from a sheet feed cassette, and is separated sheet by sheet with a separating roller. Then, the recording sheet is sent into a sheet feed path, and is conveyed to a registration roller with a conveyance roller. The recording sheet is stopped by hitting against the registration roller.

The registration roller is rotated so that the recording sheet is sent into the secondary transfer roller 13 in accordance with a timing when the composite color image on the intermediate transfer belt 10 is sent into the secondary transfer area. Generally, the registration roller is used while connected to the ground. However, the registration roller may be applied with bias so as to remove dust.

In the secondary transfer area, the composite color image is transferred onto the recording sheet by action of a bias applied to the secondary transfer roller 13. Then, the recording sheet carrying the composite color image is sent into the fuser. The fuser fixes the composite color image on the recording sheet by applying heat and pressure. The recording sheet is output to an sheet output tray via a output roller.

In addition, the image forming apparatus 200 is capable of forming a single-color image on a recording sheet. For example, when a black-only image is formed on a recording sheet, the photoconductive drums 2 for yellow, cyan, and magenta colors are preferably detached from the intermediate transfer belt 10 with an un-illustrated detachment mechanism. Further, drive of the photoconductive drums 2 for yellow, cyan, and magenta colors are preferably suspended.

The image forming apparatus 200 has a relatively short and simplified sheet-conveyance path from the sheet feed cassette to the sheet output tray. Thereby, higher productivity may be obtained, and an occurrence of sheet jam may be suppressed.

In the image forming apparatus 200, the optical writing unit 1 is arranged under the image forming mechanisms 300 to provide a route through which a recording sheet is conveyed from a lower side to an upper side of the secondary transfer roller 13. Consequently, toner may be scattered from the image forming mechanisms 300, the intermediate transfer belt 10, etc., which are arranged above the optical writing unit 1. Further, the scattered toner may fall onto the optical writing unit 1.

Therefore, in the present example embodiment, a whole body of the optical writing unit 1 is covered with a cover to suppress getting of the scattered toner into the optical writing unit 1. However, the optical writing unit 1 emits a light beam onto each of the photoconductive drums 2. Therefore, the cover has four exit lenses at appropriate portions so that respective light beams emitted from the optical writing unit 1 may pass through the cover.

Then, in each of the image forming mechanisms 300, a writing position of the light beam is configured to deviate from a bottom point of the photoconductive drum 2. Specifically, the writing position of the light beam is configured so that an angle, $\phi$, formed with a transfer position (i.e. a top point), TP, and the writing position, WP, of the photoconductive drum 2 becomes 145° as illustrated in FIG. 1. Thereby, accumulation of the scattered toner on the exit lens may be suppressed.

With this configuration, a beam path of the light beam can be inclined relative to a vertical line. Accordingly, a lens surface of the exit lens orthogonally arranged to the beam path can be inclined relative to a horizontal plane. Thus, even when the scattered toner is fell onto the exit lens, the scattered toner is slipped down an inclined surface of the exit lens, thereby suppressing accumulation of the scattered toner on the exit lens.

Next, a drum drive mechanism 400 to drive each of the photoconductive drums 2 is described.

Figure 2:
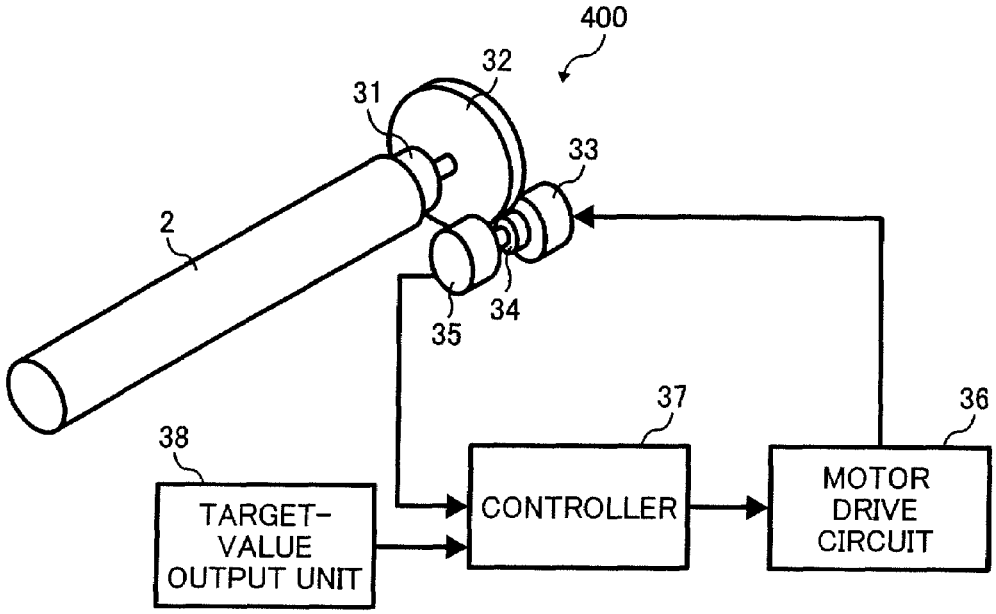
FIG. 2 is an explanatory diagram illustrating a drum drive mechanism to drive a photoconductive drum.

FIG. 2 is an explanatory diagram illustrating a drum drive mechanism 400 of the photoconductive drum 2 according to the present example embodiment. The drum drive mechanisms 400 have a similar configuration for the photoconductive drums 2 of cyan, magenta, yellow, and black.

According to the present example embodiment, a rotation shaft (hereinafter, "drum shaft") of the photoconductive drum 2 is rotatably supported with a frame of the image forming apparatus 200.

As illustrated in FIG. 2, the drum drive mechanism 400 of the present example embodiment includes a coupling 31, a drum drive gear 32, a drive motor 33, a motor shaft gear 34, a rotary encoder 35, a motor drive circuit 36, a controller 37, and a target value output unit 38.

The drive motor 33 also includes a stepping motor, a DC servo motor, etc. The motor shaft gear 34 is provided for a motor shaft of the drive motor 33. The drum drive gear 32 is fixed to a drive shaft so as to be engaged with the motor shaft gear 34. The coupling 31 connects the drive shaft with the drum shaft of the photoconductive drum 2.

According to the present example embodiment, the drum drive mechanism 400 employs a one-step deceleration structure including the motor shaft gear 34 and the drum drive gear 32. This structure may reduce the count of components, thereby saving manufacturing cost thereof. The one-step deceleration structure may also reduce error factors in gear transmission, such as deviations in gear-teeth shape and gear-core position.

In addition, when a relatively high deceleration ratio is set in the one-step deceleration structure, the drum drive gear 32 has a relatively large diameter compared to the diameter of the photoconductive drum 2. Thus, such a relatively large diameter of the drum drive gear 32 may provide a smaller single-pitch error of the drum drive gear 32 estimated as an error on the photoconductive drum 2. Thereby, un-evenness in print density in a sub-scanning direction may be suppressed.

Incidentally, the deceleration ratio is determined based on a speed range where relatively high efficiency and rotation accuracy are obtained with respect to the target rotation speed and motor characteristics of the photoconductive drum 2. According to the present example embodiment, a deceleration ratio between the motor shaft gear 34 and the drum drive gear 32 is set to 1:20.

The rotary encoder 35 is set to the motor shaft. The rotary encoder 35 detects a rotating state of the drive motor 33, and feeds a detection signal back to the motor drive circuit 36 of the drive motor 33 through the controller 37. Thus, the drive motor 33 is controlled to rotate at a desired speed.

When the drive motor 33 contains a speed sensor or an encoder, the rotary encoder 35 may be omitted from the drum drive mechanism 400. The speed sensor may be a printed-coil frequency generator. The encoder may be a magneto-resistive (MR) sensor.

The motor drive circuit 36 outputs a given drive current to the drive motor 33. The rotary encoder 35 detects a rotation angular speed or a rotation angular displacement of the drive motor 33, and outputs a detection result thereof to the controller 37.

According to the present example embodiment, the drive motor 33 employs a DC servo motor, which is a kind of DC brushless motor. The DC servo motor includes a coil and a rotor to which three phases of U, V, and W are connected in a star configuration. The DC servo motor also includes three hall elements as a rotor position detector to detect a magnetic pole of the rotor. Each of the three hall elements has an output terminal connected to the motor drive circuit 36.

The DC servo motor containing an MR sensor is provided with a rotation speed detection unit having the MR sensor and a magnetic pattern formed around the rotor. The rotation speed detection unit has an output terminal connected to the controller 37.

The motor drive circuit 36 has three higher transistors and three transistors. The three higher transistors are connected to U, V, and W, respectively. The three lower transistors are also connected to U, V, and W, respectively.

The motor drive circuit 36 determines a rotor position based on rotor position signals generated from the hall elements, and generates a phase switching signal. An on-and-off state of each of the transistors is controlled based on the phase switching signal. Thus, an exciting phase is sequentially switched, and thereby the rotor is rotated.

The controller 37 compares a rotation speed detected in the rotary encoder 35 or the rotation speed detection unit with a target rotation speed. Then, the controller 37 generates a PWM (pulse-width modulated) signal so as to match a detected rotation speed of the motor shaft with the target rotation speed. The PWM signal is ANDed with the phase switching signal generated from the motor drive circuit 36 in an AND gate. Further, the drive current is chopped. Thus, the rotation speed of the drive motor 33 is controlled.

The controller 37 may be configured with a PLL control circuit system to compare a pulse signal being output from the rotary encoder 35 or the rotation speed detection unit with a pulse signal being output from the target value output unit 38 with respect to phase and frequency.

The target value output unit 38 outputs a pulse signal having a frequency modulated corresponding to a given target rotation speed to correct a variable component in rotation speed having a rotation period of the photoconductive drum 2.

The controller 37 may be an analogue circuit or a digital circuit. For digital processing, the controller 37 measures a period of the pulse signal being output from the rotary encoder 35 or the rotation speed detection unit, and calculates a rotation angular speed. Alternatively, the controller 37 counts the number of pulse signals being output from the rotary encoder 35 or the rotation speed detection unit, and calculates a rotation angular speed based on the counted number of pulse signals in a given time.

When the position control system controls a rotation angular displacement instead of the rotation angular speed, the controller 37 counts the number of pulse signals being output from the rotary encoder 35 or the rotation speed detection unit, and calculates a displacement amount of the rotation angle.

Then, the controller 37 calculates a difference between the calculated displacement amount and the target amount generated from the target value output unit 38. The drive of the drive motor 33 is controlled so as to reduce the difference. Generally, the controller 37 contains a PID (proportional integral derivative) control unit, etc., to control a PMW signal so as to suppress a deviation, an overshoot, and an oscillation of the photoconductive drum 2 relative to the target rotation speed. Thus, the PMW signal is output to the motor drive circuit 36.

Next, rotation drive control of the photoconductive drum 2 is described.

According to the present example embodiment, a brushless DC servo motor is employed as the drive motor 33 to drive each of the photoconductive drums 2. On driving each of the photoconductive drums 2, a variation in surface moving speed of the photoconductive drum 2 may be independently caused by the following two factors. Then, when single-color toner images formed on the photoconductive drums 2 are superimposingly transferred onto the intermediate transfer belt 10, transfer positions of the single-color toner images may be displaced relative to each other, thereby causing a so-called color displacement.

The first factor of the color displacement is a variation in motor rotation caused by torque ripple, etc. Further, the variation in motor rotation may cause a variation in rotation angular speed transmitted to the photoconductive drum 2. Furthermore, the variation in rotation angular speed causes a variation in surface moving speed of each of the photoconductive drums 2. As a result, transfer positions at which the single-toner images are transferred on the intermediate transfer belt 10 are displaced in the surface moving direction of the intermediate transfer belt 10 (hereinafter, "positional displacement").

The second factor of the color displacement is a variation in gear transmission caused by gear members. Specifically, the gear members, including the drum drive gear 32, of the drum drive mechanism 400 may produce an accumulated pitch error. Further, the drum drive gear 32 may have an eccentricity relative to the rotation shaft, thereby causing a variation in rotation angular speed transmitted to the photoconductive drum 2. Furthermore, the variation in rotation angular speed may cause a variation in surface moving speed of the photoconductive drum 2, further causing a positional displacement.

The variation in surface moving speed of the photoconductive drum 2 caused by the first factor may be suppressed through the above-described feedback control based on a detection result in the rotary encoder 35 provided at the motor shaft.

The variation in surface moving speed of the photoconductive drum 2 caused by the second factor may be suppressed by the following control scheme. First, an amplitude and a phase of a variable component of surface moving speed occurring in a rotation period of the photoconductive drum 2 are calculated based on a detection result of an adjustment pattern. Then, the rotation angular speed of the drive motor 33 is controlled so as to suppress the variation in surface moving speed based on calculated amplitude and phase.

Next, a detection method of a transfer position adjustment pattern 44 is described.

Figure 3:
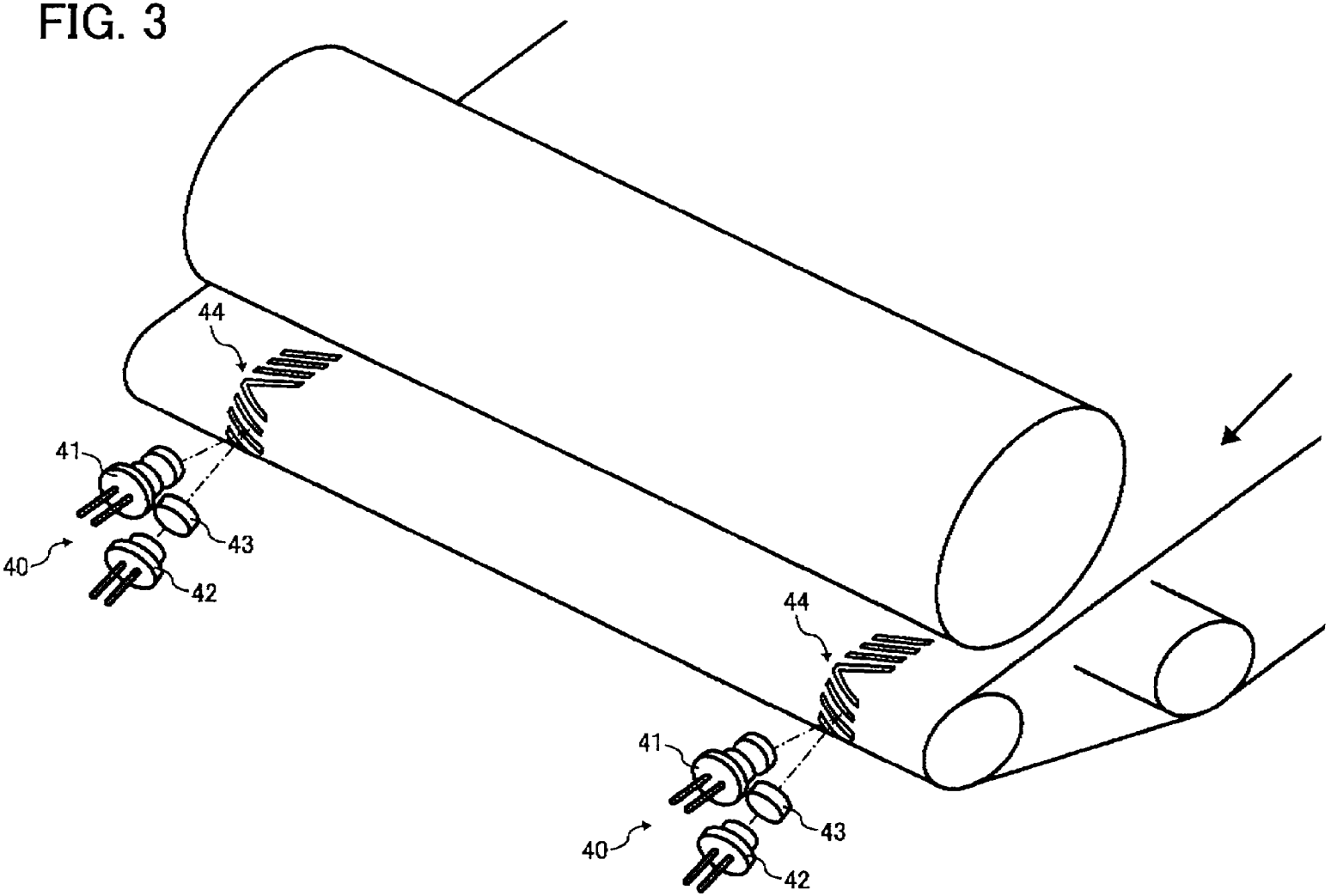
FIG. 3 is an explanatory diagram illustrating a pattern sensor to detect an adjustment pattern formed on an intermediate transfer belt.

FIG. 3 is an explanatory diagram illustrating a pattern detection mechanism to detect a transfer position adjustment pattern 44 having been formed on the intermediate transfer belt 10 with the image forming mechanisms 300. In FIG. 3, two pattern sensors 40 are arranged at different places from the place of the pattern sensor 40 in FIG. 1 for convenience of description.

According to the present example embodiment, the pattern sensors 40 are arranged along both end portions in the belt-width direction in an image area of the intermediate transfer belt 10. Each of the pattern sensors 40 includes an LED (light emitting diode) element 41, a light-sensitive element 42, and a condenser lens 43.

The LED element 41 serves as an illumination light source and emits a light to the transfer position adjustment pattern 44 formed on the intermediate transfer belt 10. The condenser lens 43 condenses the light reflected on the transfer position adjustment pattern 44.

The light-sensitive element 42 receives the reflected light condensed through the condenser lens 43. The light-sensitive element 42 is arranged at a position at which the reflected light is incident through the condenser lens 43. The light-sensitive element 42 includes a CCD (charge-coupled device) in which a large number of light-sensitive pixels are linearly arranged.

As described above, according to the present example embodiment, the pattern sensors 40 are arranged along both ends in the belt-width direction in the image area of the intermediate transfer belt 10. Thereby, appropriate adjustment can be made for positional displacement in the main scanning direction. In addition, appropriate adjustment can be made for positional displacement, magnification error, and scanning line inclination in the sub-scanning direction.

Figure 4:
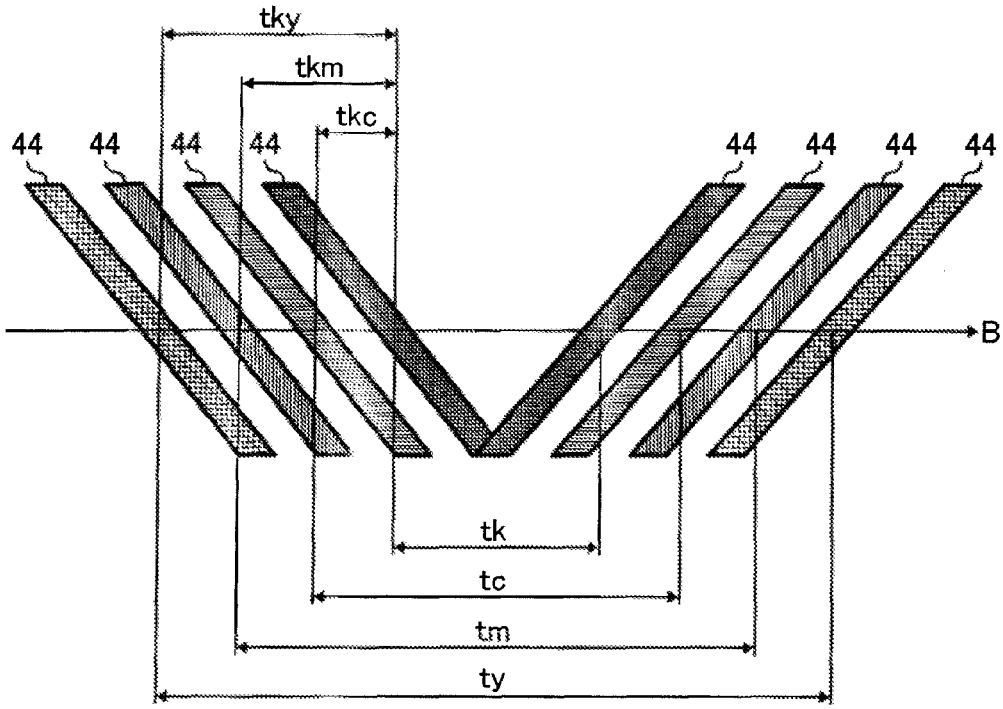
FIG. 4 is an explanatory diagram illustrating a transfer position adjustment pattern.

FIG. 4 is an explanatory diagram illustrating a transfer position adjustment pattern 44 according to the present example embodiment.

As illustrated in FIG. 1, the transfer position adjustment pattern 44 includes toner images in black, cyan, magenta, and yellow. The transfer position adjustment pattern 44 is formed so as to have a so-called chevron shape. Specifically, the toner images in black, cyan, magenta, and yellow are inclined at substantially 45 degree with respect to the sub-scanning direction of the intermediate transfer belt 10 indicated by an arrow B in FIG. 4. Accordingly, the toner images in black, cyan, magenta, and yellow are arranged in parallel to each other in a given pitch.

The transfer position adjustment pattern 44 is formed on each of both ends of the image area of the intermediate transfer belt 10 in the belt-width direction. The transfer position adjustment pattern 44 is detected with the pattern sensor 40. At this time, differences in detection time are measured between a black toner image as a reference color and each of the other color toner images.

For example, as illustrated in FIG. 4, the transfer position adjustment pattern 44 is formed to have toner images in an order of yellow, magenta, cyan, black, black, cyan, magenta, and yellow. When the pattern sensor 40 sequentially detects the toner images, detection time differences, tky, tkm, and tkc, are measured between the black toner image and each of yellow, magenta, and cyan toner images, respectively.

Further, a difference between the actually measured value and a corresponding theoretical value is determined for each of the detection time differences, tky, tkm, and tkc. Then, positional displacement amounts in the sub-scanning direction are obtained between the black toner image and each of the other color toner images.

Furthermore, based on the detection result with the pattern sensor 40, detection time differences, tk, tc, tm, and ty, are determined between two toner images different in inclination angle for each color of black, cyan, magenta, and yellow. Then, a difference between the actually measured value and a corresponding theoretical value is determined for each of the detection time differences, tk, tc, tm, and ty. Moreover, based on the difference, positional displacement amounts in the sub-scanning direction are obtained between the black toner image and each of the other color toner images.

An inclination amount of the scanning line is determined based on the positional displacement amounts in the sub-scanning direction obtained from two adjustment patterns 44 formed on both ends of the intermediate transfer belt 10. Further, based on the inclination amount, inclination of a toroidal lens is controlled so as to correct the inclination of the scanning line.

In correcting the positional displacement in the sub-scanning direction, a positional displacement amount in the sub-scanning direction is determined based on an average of the detection values. Then, a writing timing is adjusted corresponding to the positional displacement amount in unit of one surface of a polygon mirror, that is, a scanning line pitch.

Alternatively, an average rotation angular speed of the drive motor 33 for the photoconductive drum 2 may be adjusted corresponding to the positional displacement amount. At this time, the adjustment is made for a rotation time of the photoconductive drum 2 from the writing position to the transfer position thereon.

Figure 5:
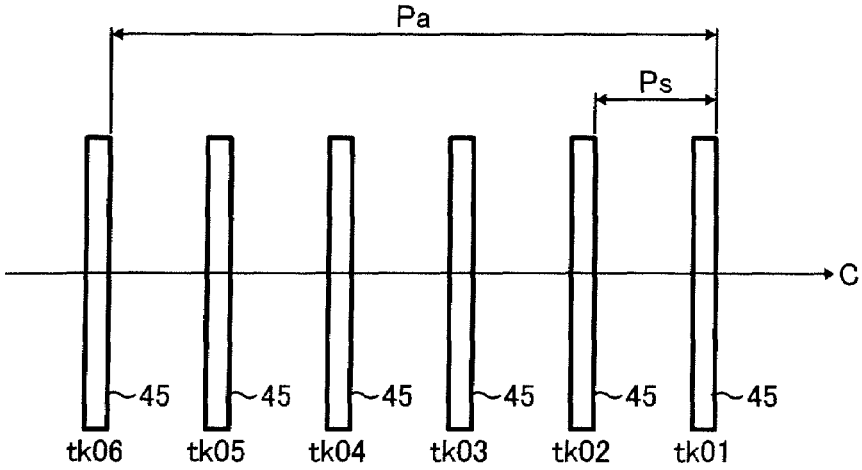
FIG. 5 is an explanatory diagram illustrating an adjustment pattern employed to correct a periodic variation in surface moving speed of the photoconductive drum.

FIG. 5 is an explanatory diagram illustrating an adjustment pattern 45 employed to suppress a variation in surface moving speed of the photoconductive drum 2 caused by the above-described second factor.

The adjustment pattern 45 includes toner images formed in one of black, cyan, magenta, and yellow colors. The toner images have a longer length in the belt-width direction of the intermediate transfer belt 10. The toner images are arranged at a given pitch in parallel to each other along the surface moving direction of the intermediate transfer belt 10 indicated by an arrow C in FIG. 5.

The pattern sensor 40 sequentially detects the toner images in an order in which the toner images have been formed along the surface moving direction of the intermediate transfer belt 10. Then, elapsed times, such as tk01, tk02, tk03, and tk04, from a reference time to each detection time of the toner images are determined for each color.

According to the present example embodiment, two adjustment patterns 45 different in color are formed on both ends of the intermediate transfer belt 10 in the belt-width direction. Further, as described above, the two pattern sensors 40 are arranged along both ends of the intermediate transfer belt 10 in the belt-width direction.

Accordingly, a simultaneous detection for two colors can be performed with the two pattern sensors 40. That is, according to the present example embodiment, detection of the two adjustment patterns 45 of four colors can be finished by repeating the detecting operation twice, reducing a detection time of the adjustment pattern 45.

Further, according to the present example embodiment, each of the two adjustment patterns 45 is formed in a single color. Therefore, a relatively short interval may be set between toner images included in each of the two adjustment patterns 45. Thereby, higher accuracy may be obtained in the detection.

Figure 6:
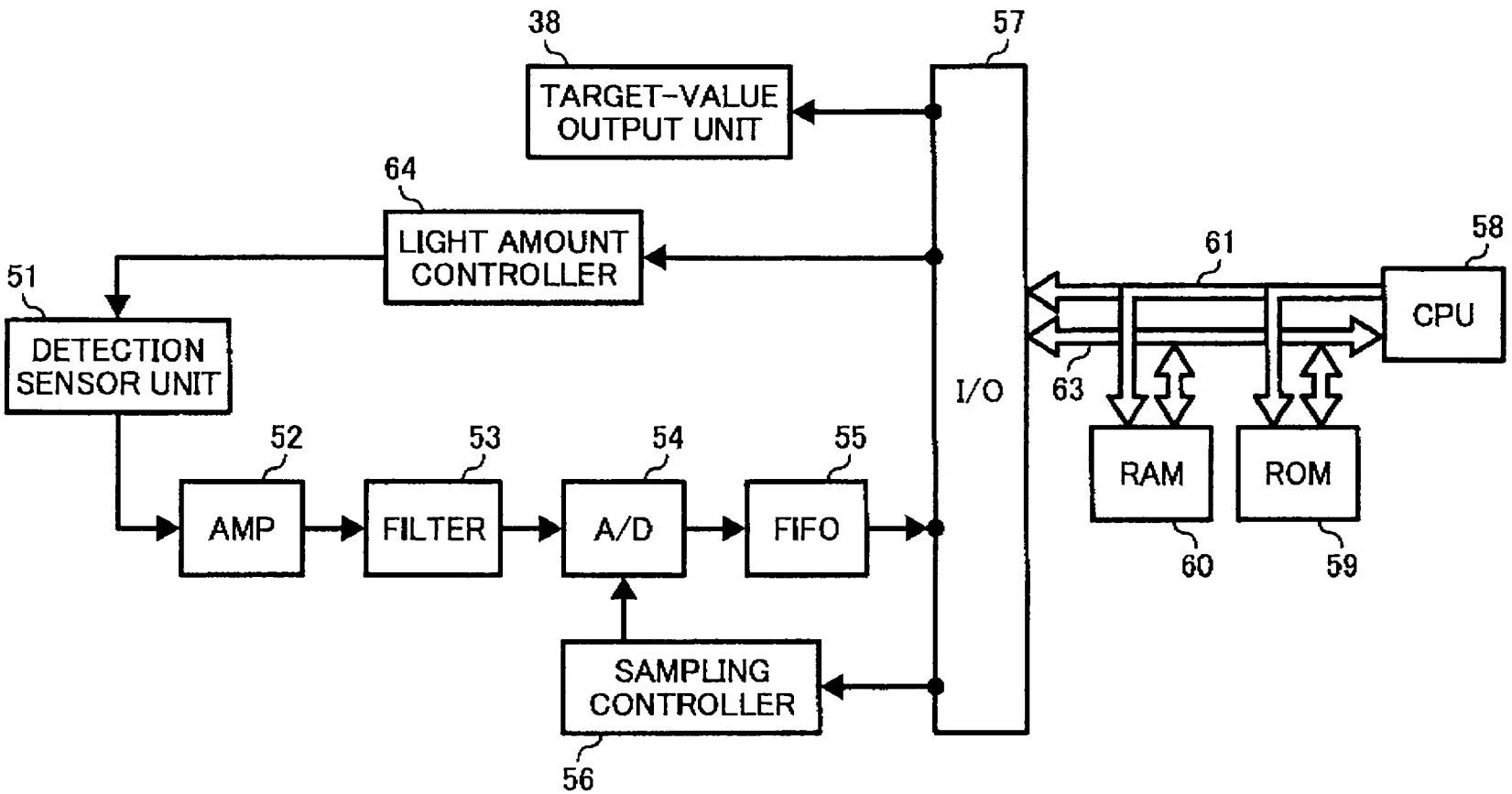
FIG. 6 is a block diagram illustrating an electric hardware configuration of the drum drive mechanism.

FIG. 6 is a block diagram illustrating an electrical hardware configuration of the drum drive mechanism 400 of FIG. 2.

As illustrated in FIG. 6, the drum drive mechanism 400 includes, as the electrical hardware configuration, a detection sensor unit 51, an amplifier (AMP) 52, a filter 53, an analog-to-digital (A/D) converter 54, a FIFO (first-in first-out) memory 55, a sampling controller 56, an input-and-output (I/O) port 57, a CPU (central processing unit) 58, a ROM (read-only memory) 59, a RAM (random access memory) 60, an address bus 61, a data bus 63, a light amount controller 64, and the target-value output unit 38.

A signal generated in the detection sensor unit 51 including the pattern sensor 40 illustrated in FIG. 3 is amplified with an amplifier 52. An amplified signal is output to the filter 53. Then, only a signal component of the transfer position adjustment pattern 44 or the adjustment pattern 45 is passed through the filter 53.

A filtered signal is converted from analog to digital data with the analog-to-digital converter 54. Data sampling in the analog-to-digital conversion is controlled with the sampling controller 56. Sampled data are stored into the FIFO memory 55.

After the detection of the adjustment pattern 45, the stored data are loaded onto the CPU 58 and the RAM 60 via the input-and-output port (I/O) 57 through the data bus 63. Then, computations are performed in the CPU 58 to calculate various positional displacement amounts as described above.

The CPU 58 first changes settings for writing control and drive of an un-illustrated stepping motor serving as a drive source of the intermediate transfer belt 10. Through changing the settings, the CPU 58 performs skew correction, change of main scanning registration, change of sub-scanning registration, and change of image frequency corresponding to magnification error. The CPU 58 also performs the above correction and changes based on corresponding correction values calculated from a detection signal of the transfer position adjustment pattern 44 as illustrated in FIG. 4.

For the writing control, the image forming apparatus 200 is provided with a device, such as a clock generator employing a VCO (voltage controlled oscillator), for each color that is capable of finely setting an output frequency and controlling registration in the main scanning direction and the sub-scanning direction. According to the present example embodiment, the image forming apparatus 200 employs an output from the clock generator as an image clock.

Then, a drive control value of the drive motor 33 is corrected based on the correction value calculated from the detection signal of the adjustment pattern 45. The correction is performed so as to reduce a positional displacement amount occurring in a rotation period of the photoconductive drum 2. A corrected drive control value is set in the target-value output unit 38. The target-value output unit 38 outputs a rotation-speed target signal to each of the photoconductive drums 2. Incidentally, the rotation-speed target signal may be a digital data signal or a pulse signal.

The CPU 58 also monitors the detection signal from the detection sensor unit 51 at an appropriate interval. Further, the CPU 58 controls a light amount emitted from the optical writing unit 1 via a light amount controller 38. Thereby, a signal level of received light transmitted from the light-sensitive element 42 of the detection sensor unit 51 is maintained constant. Thus, even when the intermediate transfer belt 10 or the LED element 41 in the detection sensor unit 51 is deteriorated, the adjustment pattern 45 may be appropriately detected.

The ROM 59 stores various programs including a program to compute various displacement amounts as described above. A ROM address, a RAM address, and various input-and-output devices are specified via the address bus 61.

Next, a description is given for a configuration and an operation to suppress variation in surface moving speed of the photoconductive drum 2 caused by the above-described second factor.

According to the present example embodiment, the adjustment pattern 45 as illustrated in FIG. 5 is employed in the configuration and the operation to suppress variation in surface moving speed of the photoconductive drum 2 caused by the above-described second factor. The adjustment pattern 45 having one color of yellow, magenta, cyan, and black is sequentially formed on the intermediate transfer belt 10 along the surface movement direction thereof. At this time, the adjustment pattern 45 is formed in relatively large quantity, for example, while the photoconductive drum 2 is rotated a plurality of times.

Then, sampling is performed on the adjustment pattern 45 formed on the intermediate transfer belt 10. Incidentally, a large-quantity formation of the adjustment pattern 45 having a plurality of colors may cause degradation in the adjustment pattern 45, such as deterioration of toner image due to reverse transfer.

Then, according to the present example embodiment, the adjustment pattern 45 is formed in a single color as described above. Accordingly, the above degradation may be suppressed, and the adjustment pattern 45 may be detected with relatively high accuracy.

Alternatively, when the above degradation is not so noticeable, the adjustment pattern 45 is formed in an order of yellow, magenta, cyan, and black toner images. Further, the yellow, magenta, cyan, and black toner images are formed so as to be in parallel to each other along the sub-scanning direction.

As illustrated in FIG. 5, a sampling pattern length, Pa, of the adjustment pattern 45 to be sampled along the surface moving direction of the intermediate transfer belt 10 is set to a length of an integral multiple of a rotation speed variation period. On the setting of the sampling pattern length, Pa, a consideration should be made for other periodic rotation variations in forming and detecting the adjustment pattern 45 on the intermediate transfer belt 10.

Factors influencing the other periodic rotation variations include various frequency components, such as a periodic rotation variation of the drive support roller 8 of the intermediate transfer belt 10, a pitch error and an eccentric component of the gear to transmit a rotation force of the drive support roller 8, a walk of the intermediate transfer belt 10, a deviation distribution of thickness in a circumferential direction of the intermediate transfer belt 10.

All of the above frequency components are superposed in detection data. A variable component having the rotation period of the photoconductive drum 2 should be detected with relatively high accuracy. Then, a pattern interval, Ps, between two adjacent toner images in the adjustment pattern 45 is set so as to be substantially constant.

Further, the pattern interval, Ps, is preferably set to be relatively short so as to form the adjustment pattern 45 in relatively dense. However, the pattern interval, Ps, is determined in further consideration with available pattern width, computing time, etc.

In addition to the variable components having the rotation period of the photoconductive drum 2, a variable component having a rotation period of the drive support roller 8 may significantly influence the positional displacement of the adjustment pattern 45. In this case, the sampling pattern length, Pa, is determined in consideration with the variable component having the rotation period of the drive support roller 8 in addition to the variable components having the rotation period of the photoconductive drum 2.

For example, when a diameter of the photoconductive drum 2 is 40 mm, a rotation period of the photoconductive drum 2 becomes 125.7 mm when converted to a surface moving distance of the intermediate transfer belt 10. Further, when a diameter of the drive support roller 8 is 30 mm, a rotation period of the drive support roller 8 becomes 94.2 mm when converted to a surface moving distance of the intermediate transfer belt 10.

According to the present example embodiment, the sampling pattern length, Pa, is set to 377 mm, that is, a least common multiple between the above rotation periods of the photoconductive drum 2 and the drive support roller 8. Further, the pattern interval, Ps, is set to a value so that toner images of the adjustment pattern 45 are arranged at a constant interval with respect to the sampling pattern length, Pa.

Thus, the influence of the variable component caused by the drive support roller 8 may be suppressed, and therefore the variable component having the rotation period of the photoconductive drum 2 may be detected with relatively high accuracy. Furthermore, the below-described amplitude and phase of the variable component having the rotation period of the photoconductive drum 2 may be computed with relatively high accuracy. This computation assumes that a term including a variable component caused by the drive motor 8 theoretically becomes zero.

Moreover, a periodic rotation variation of the intermediate transfer belt 10 may be caused by the deviation distribution of thickness in the circumferential direction thereof. In this case, the sampling pattern length, Pa, is set so as to be an integral multiple of the rotation period of the photoconductive drum 2 and be nearest to the circumferential length of the intermediate transfer belt 10. Thus, influence of the periodic variation of the intermediate transfer belt 10 may be suppressed.

In addition, a variable component having a more than ten times longer period than a rotation period of the photoconductive drum 2 may influence the positional displacement of the adjustment pattern 45. An example thereof is a variable component having a rotation period of the drive motor 33, which serves as the drive source of the drive support roller 8. Such a variable component can be suppressed with a low pass filter in digital processing.

When a feedback control is provided in a drive mechanism of the intermediate transfer belt 10, relatively high accuracy may be obtained in the detection of the variable component having the rotation period of the photoconductive drum 2. According to the present example embodiment, a rotary encoder is provided at a rotation shaft of the support roller 12 that is rotated together with the surface moving of the intermediate transfer belt 10. Based on rotation information being output from the rotary encoder, the drive mechanism of the intermediate transfer belt 10 controls rotation of the un-illustrated drive motor so that a rotation angular speed being output from the rotary encoder is kept substantially constant. Thus, errors resulting from the drive support roller 8 and the drive transmission mechanism, and a belt speed variation resulting from slippage between the drive support roller 8 and the intermediate transfer belt 10 may be effectively suppressed.

Then, another one of the periodic rotation variations to be considered is a variation having a rotation period of the support roller 12. This variation may be mainly caused by eccentricity of the support roller 12 or eccentric installation of the rotary encoder. Accordingly, the variation having the rotation period of the support roller 12 may be detected with relatively high accuracy by setting a sampling pattern length, Pa, to be a length of a least multiple period between a rotation period of the support roller 12 and a rotation period of the photoconductive drum 2.

According to the present example embodiment, effective suppression may be achieved for deterioration in image quality due to a positional displacement that may occur in continued use of the image forming apparatus 200, in addition to a positional displacement that may occur in factory default setting thereof.

Specifically, a position or a size of each of the image forming mechanisms 300 may be subtly changed by a temperature variation inside the image forming apparatus 200 or an external force applied thereto. The temperature variation or the external force may be caused by normal operations, such as a recovery operation from paper jam, part replacement in a maintenance-and-inspection operation, relocation of the image forming apparatus 200. Therefore, the temperature variation or the external force may distort registration of images formed with the image forming mechanisms 300. Thus, a factor occurring in continued use of the image forming apparatus 200 may cause a positional displacement, thereby deteriorating image quality.

Then, when needed, a sampling operation of the adjustment pattern 45 and a correcting operation based on a result thereof are preferably executed at appropriate timings, such as at turn-on of the image forming apparatus 200, after a recovery operation from paper jam, before image formation, and during image formation. According to the present example embodiment, each of the sampling operation of the adjustment pattern 45 and the correcting operation based on a result thereof is automatically executed only once at turn-on of the image forming apparatus 200 or after a maintenance-and-inspection operation thereof.

Generally, variable components causing the positional displacement and having the rotation period of the photoconductive drum 2 mainly result from errors in dimensional accuracy and positioning accuracy of the photoconductive drum 2, the drum drive gear 32, the coupling 31, etc. On the other hand, the variable components irregularly caused by the temperature variation or the continued use have only small effects to the positional displacement. Therefore, the sampling operation of the adjustment pattern 45 and the correcting operation based on the result thereof may be performed at relatively low frequency as described above.

Incidentally, from the viewpoint of increase in detection accuracy, the sampling operation of the adjustment pattern 45 and the correcting operation based on the result thereof are preferably performed after the sampling operation of the transfer position adjustment pattern 44 and the correction operation based on the result thereof.

When the sampling operation of the adjustment pattern 45 and the correcting operation based on the result thereof are executed, the CPU 58 illustrated in FIG. 6 issues instructions to various parts at appropriate timings, such as when the marking 4 illustrated in FIG. 4 is detected with the drum position sensor 20. Then, image data of the adjustment pattern 45 for each of the photoconductive drums 2 stored in the ROM 59 is in turns output to a corresponding one of the image forming mechanisms 300. At this time, image formation is performed in a normal image forming mode of the image forming apparatus 200.

Each of the image forming mechanisms 300 forms the adjustment pattern 45 based on the image data, and superimposingly transfers the adjustment pattern 45 onto the intermediate transfer belt 10. Thus, two adjustment patterns 45 are formed on the intermediate transfer belt 10.

Further, a detection result of the adjustment pattern 45 in the detection sensor unit 51 is stored in the FIFO memory 55 at an appropriate sampling period having been set in the sampling controller 56. At this time, the detection result is stored as discrete data having been converted in the analog-to-digital converter 54. The data stored in the FIFO memory 55 includes a numeric value of output signal corresponding to a light amount that is reflected on the adjustment pattern 45 and is received at the light-sensitive element 42. The numeric value varies with toner color or toner density of the adjustment pattern 45.

According to the present example embodiment, a passing timing of the adjustment pattern 45 is preferably determined with relatively high accuracy. Therefore, the passing timing of the adjustment pattern 45 is determined according to a peak recognition of the numeric value, not according to a previously defined threshold value. Thereby, effective suppression may be achieved for deterioration of the detection accuracy due to distortion of the adjustment pattern 45 that is caused by a variation in the surface moving speed of the photoconductive drum 2. Thus, the positional displacement may be detected with relatively high accuracy. Below, a further detailed description is given.

Figure 7A:
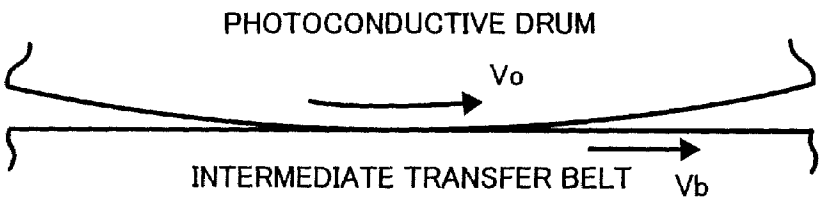
FIG. 7A is a schematic diagram of a transfer area between the photoconductive drum and the intermediate transfer belt.
Figure 7B:
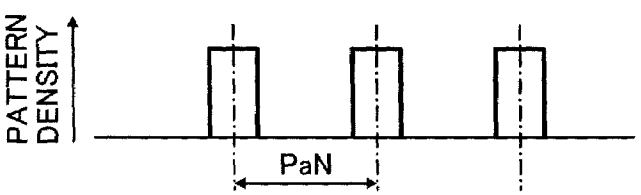
FIG. 7B is an explanatory diagram illustrating relationship between toner density and pattern interval of an adjustment pattern formed on the photoconductive drum.

FIGS. 7A and 7B are explanatory diagrams illustrating relationship between surface moving speed of the photoconductive drum 2 and toner density distribution of the adjustment pattern 45 transferred onto the intermediate transfer belt 10.

FIG. 7A is a schematic diagram of a transfer area between the photoconductive drum 2 and the intermediate transfer belt 10. In an interface between the photoconductive drum 2 and the intermediate transfer belt 10, the photoconductive drum 2 and the intermediate transfer belt 10 contact each other. Meanwhile, the photoconductive drum 2 and the intermediate transfer belt 10 slips each other with a toner, a lubricant agent, and a lubricant layer on surfaces thereof. Thus, the surfaces of the photoconductive drum 2 and the intermediate transfer belt 10 move at independent speeds of Vo and Vb, respectively.

FIG. 7B is a graph illustrating relationship between toner density on the vertical axis and interval distance between adjacent toner images on the horizontal axis, with respect to the adjustment pattern 45 formed on the photoconductive drum 2. According to the present example embodiment, toner images of the adjustment pattern 45 are formed at a substantially constant toner density and at a substantially constant pattern interval, PaN.

Figure 7C:
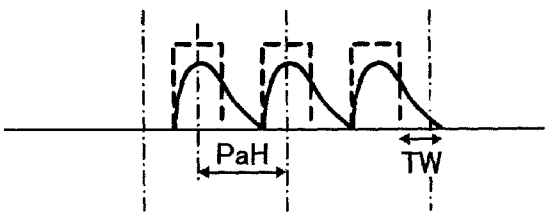
FIG. 7C is an explanatory diagram illustrating an adjustment pattern transferred on the intermediate transfer belt when the surface moving speed of the photoconductive drum is higher than the surface moving speed of the intermediate transfer belt.

FIG. 7C illustrates the adjustment pattern 45 transferred onto the intermediate transfer belt 10 when a surface moving speed, Vo, of the photoconductive drum 2 is higher than a surface moving speed, Vb, of the intermediate transfer belt 10. In this case, the surface of the photoconductive drum 2 precedes the surface of the intermediate transfer belt 10 at the transfer area. Therefore, a pattern interval, PaH, between adjacent toner images of the adjustment pattern 45 formed on the intermediate transfer belt 10 becomes shorter than the pattern interval, PaN, between adjacent toner images of the adjustment pattern 45 formed on the photoconductive drum 2.

Further, a skirt portion of the toner density line indicated by an arrow, TW, in FIG. 7C represents a variation in toner density distribution due to distortion of the adjustment pattern 45 that is caused by the speed difference of the photoconductive drum 2 and the intermediate transfer belt 10.

In the transfer area, a nip portion of substantially 2 mm is formed between the photoconductive drum 2 and the intermediate transfer belt 10 to obtain relatively high transfer efficiency. Therefore, a toner image may be rubbed against each of the photoconductive drum 2 and the intermediate transfer belt 10. As a result, toner particles aggregating in the toner image may be displaced corresponding to a speed difference between the photoconductive drum 2 and the intermediate transfer belt 10. Thus, the above variation in toner density distribution may be observed as illustrated in FIG. 7C.

Figure 7D:
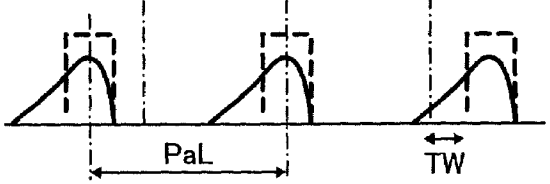
FIG. 7D is an explanatory diagram illustrating an adjustment pattern transferred on the intermediate transfer belt when the surface moving speed of the photoconductive drum is lower than the surface moving speed of the intermediate transfer belt.

On the other hand, FIG. 7D illustrates the adjustment pattern 45 transferred onto the intermediate transfer belt 10 when the surface moving speed, Vo, of the photoconductive drum 2 is lower than the surface moving speed, Vb, of the intermediate transfer belt 10. In this case, a pattern interval, PaL, between adjacent toner images of the adjustment pattern 45 formed on the intermediate transfer belt 10 becomes longer than the pattern interval, PaN, between adjacent toner images of the adjustment pattern 45 formed on the photoconductive drum 2. Similar to the case illustrated in FIG. 7C, a skirt portion of toner density line indicated by an arrow, TW, is also observed in FIG. 7D.

According to the present example embodiment, the pattern intervals, PaH and PaL, are preferably detected with relatively high accuracy. As described above, the moving speed difference between the photoconductive drum 2 and the intermediate transfer belt 10 is periodically changed with a variation in the surface moving speed of the photoconductive drum 2. In addition, a range of toner density distribution of the adjustment pattern 45 is also periodically changed therewith.

In this regard, if an edge portion of the adjustment pattern 45 is determined according to a previously defined threshold value, a non-edge portion may be improperly detected due to the pattern distortion. Then, according to the present example embodiment, a peak value of toner density is employed as a pattern detection timing when the adjustment pattern 45 is detected with the detection sensor unit 51.

Specifically, the CPU 58 selects a peak value in toner density from among a set of signal data having relatively high correlation to toner density, which stored in the FIFO memory 55 at an appropriate sampling period. Then, the CPU 58 stores timing data of the signal data selected as the peak value into the RAM 60. Thus, the pattern interval, Pah or PaL, may be detected with relatively high accuracy.

Detection data (hereinafter "pattern detection data") of the pattern interval, Pah or PaL, are stored into the RAM 60, as described above. The pattern detection data varies in a rotation period of the photoconductive drum 2. According to the present example embodiment, an amplitude and a phase of a variable component having the rotation period of the photoconductive drum 2 are detected based on the pattern detection data.

Detecting methods thereof include a method in which the amplitude and the phase of the variable component is detected based on a zero cross point or a peak value of variable assuming an average of all data is zero. However, this method may cause a large error since the pattern detection data is significantly subjected to noise in detection.

Then, according to the present example embodiment, a method may be employed in which the amplitude and the phase of a variable component occurring in the rotation period of the photoconductive drum 2 are calculated from the pattern detection data through data processing (i.e. quadrature detection processing) in a quadrature detection scheme. The quadrature detection processing is a signal analysis method generally used in demodulation circuit in the field of communication.

Figure 8:
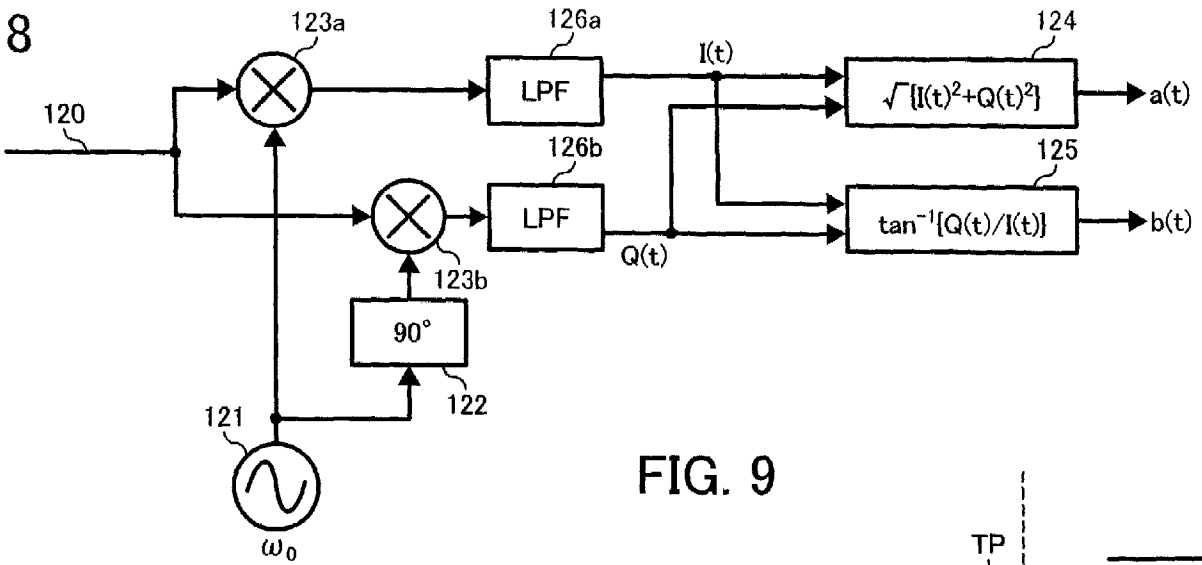
FIG. 8 is a block diagram illustrating a basic configuration of quadrature detection processing employed to calculate an amplitude and a phase of a variable component occurring in a rotation period of the photoconductive drum.

FIG. 8 is a block diagram illustrating a basic configuration of quadrature detection processing according to the present example embodiment.

As illustrated in FIG. 8, the basic configuration of quadrature detection processing includes an oscillator 121, a quadrature phase shifter 122, a multiplier 123*a*, a multiplier 123*b*, an amplitude calculator 124, a phase calculator 125, an LPF (low-pass filter) 126*a*, and an LPF (low-pass filter) 126*b*.

An input signal 120 may be generated from the pattern detection data as described above. The pattern detection data includes elapsed times, such as tk01, tk02, and tk03, from a reference time to each detection time of toner images of the adjustment pattern 45. That is, the pattern detection data includes a monotonic increasing data group in which various variable components are superposed.

Then, pattern variation data is obtained by deducting an increasing slope from the pattern detection data. The increasing slope can be calculated from the data group by using least square method. A calculated increasing slope is employed as a magnification correction value. In addition, the pattern variation data is employed as the input signal 120.

The oscillator 121 oscillates a signal at a frequency component to be detected and at a phase based on the given reference timing used in forming the adjustment pattern 45. The oscillator 121 outputs the signal to the multiplier 123*a* and the quadrature phase shifter 122. Incidentally, in the present example embodiment, the frequency component to be detected is a frequency, $\omega_0/2\pi$, of the rotation period of the photoconductive drum 2.

A rotation period, $2\pi/\omega_0$, of the photoconductive drum 2 can be accurately calculated through measuring a detection signal interval of the marking 4 formed on the dram drive gear 32 for each of the photoconductive drums 2.

The multiplier 123*a* multiplies the input signal 120 by the signal having the frequency oscillated from the oscillator 121. On the other hand, the multiplier 123*b* multiplies the input signal 120 by a signal being output from the quadrature phase shifter 122. That is, the input signal 120 is separated into a signal having in-phase component, I(t), and a signal of quadrature component, Q(t), through the multipliers 123*a* and 123*b*. The multiplier 123*a* outputs the in-phase component, I(t), to an LPF (low-pass filter) 126*a*, while the multiplier 123*b* outputs the quadrature component, Q(t), to an LPF (low-pass filter) 126*b*.

For a signal multiplied in the multiplier 123*a*, the LPF 126*a* causes only a signal in a low frequency band to pass therethrough. Similarly, for a signal multiplied in the multiplier 123*b*, the LPF 126*b* causes only a signal in a low frequency band to pass therethrough.

According to the present example embodiment, the LPF 126*a* and the LPF 126*b* are designed to smooth data in unit of an integral multiple of an oscillation period, $2\pi/\omega_0$, that is, in unit of a sampling pattern length, Pa.

The smoothing of the data in unit of a sampling pattern length, Pa, may reduce a variable component having the rotation period of the drive support roller 8.

Then, the amplitude calculator 124 calculates an amplitude, a(t), based on two inputs, I(t) and Q(t). On the other hand, the phase calculator 125 calculates a phase, b(t), based on two inputs, I(t) and Q(t). The a(t) and b(t) represent the amplitude of the periodic variation of the photoconductive drum 2 and the phase angle from the given reference point, respectively. Incidentally, through setting an oscillation period, $\omega_0$, to be a high-frequency component of the motor rotation period, similar processing to the above quadrature detection processing may be performed to detect an amplitude and a phase of a variable component having the rotation period of the motor shaft gear 34.

The calculation of the amplitude and the phase by the quadrature detection processing may reduce the amount of pattern detection data to be used, compared to other detection methods employing a zero cross point or a peak value of the variable component, etc. In particular, a pattern interval, Ps, of the adjustment pattern 45 is preferably set so that 4NP toner images (NP representing a natural number) are detected per rotation period of the photoconductive drum 2.

Thus, the amplitude and the phase may be calculated with relatively high accuracy, based on a small number of detected toner images. At this point, since a positional relation between the 4NP toner images of the adjustment pattern 45 is highly discriminative for the variable component, a relatively high sensitivity may be obtained in the calculation.

For example, when an adjustment pattern 45 having four toner images is detected, each of the four toner images corresponds to one of zero cross points and peak values of the variable component. Therefore, relatively high sensitivity may be obtained in the detection, compared to when the detected number of toner images is another natural number multiple of four. In addition, even if a deviation is observed between the phases of the four toner images, a positional relation between the four toner images may still provide relatively high sensitivity in the detection.

Based on detected data of the amplitude and the phase of the variable component having the rotation period of the photoconductive drum 2, the CPU 58 calculates a drive control correction value to control the drive of each of the photoconductive drums 2, and transmits the correction value to the target value output unit 38. The rotation angular speed of each of the photoconductive drums 2 is finely adjusted with the drive control correction value so as to suppress the variation in surface moving speed of the photoconductive drum 2 corresponding to the variable component.

Specifically, as illustrated in FIG. 7C, when a relatively shorter pattern interval, PaH, of the adjustment pattern 45 is detected since the surface moving speed of the photoconductive drum 2 is higher than the surface moving speed of the intermediate transfer belt 10, the rotation angular speed of the photoconductive drum 2 is slowed down with the drive control correction value.

On the other hand, as illustrated in FIG. 7D, when a relatively longer pattern interval, PaL, of the adjustment pattern 45 is detected since the surface moving speed of the photoconductive drum 2 is lower than the surface moving speed of the intermediate transfer belt 10, the rotation angular speed of the photoconductive drum 2 is increased up with the drive control correction value.

As described above, data of the amplitude and the phase of the variable component having the rotation period of the photoconductive drum 2 are calculated based on the pattern variation data. Specifically, the data are calculated from a variation in pattern interval on the intermediate transfer belt 10. The variation in pattern interval on the intermediate transfer belt 10 is caused by the variations in surface moving speed on the writing position, WP, and on the transfer position, TP of the photoconductive drum 2.

Figure 9:
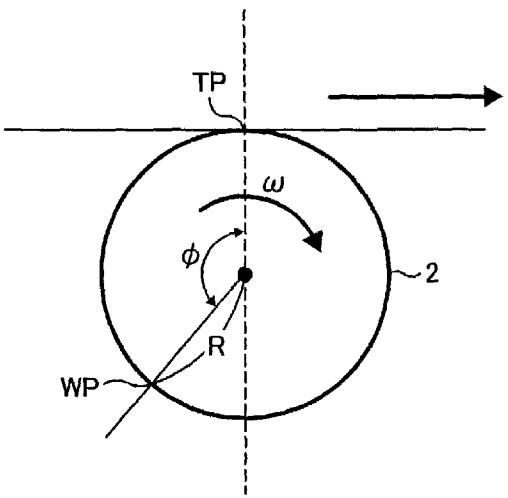
FIG. 9 is an explanatory diagram illustrating parameters employed to calculate a drive control correction value for the photoconductive drum.

Then, referring to FIG. 9, description is given to a relationship between variation in rotation angular speed of the photoconductive drum 2 and pattern interval on the intermediate transfer belt 10. Further description is given to a method of obtaining an appropriate drive control correction value from the pattern variation data based on the pattern detection data as described above. Incidentally, as illustrated in FIG. 9, the photoconductive drum 2 is configured to have a phase difference angle, $\phi$, between a writing position, WP, and a transfer position, TP, on the photoconductive drum 2.

Based on a reference timing when the drum position sensor 20 detects the marking 4, a latent image of the adjustment pattern 45 is written at a constant interval onto the writing position, WP, of the photoconductive drum 2. At this time, a rotation angular speed, $\omega$, of the photoconductive drum 2 can be expressed by the following Equation 1.

$$\omega=\omega_0+\Delta\omega\cos(\omega_0 t_0+\alpha) \quad \text{Eq. 1}$$

The second term, $\Delta\omega\cos(\omega_0 t_0+\alpha)$, of the right-hand side of Equation 1 represents a variation amount in rotation angular speed having the rotation period of the photoconductive drum 2 observed between a reference timing when the drum position sensor 20 detects the marking 4 and a given time, $t_0$. Specifically, the second term, $\Delta\omega\cos(\omega_0 t_0+\alpha)$, of the right-hand side of Equation 1 mainly represents a variation amount of a variable component in rotation angular speed caused by the eccentricity of the drum drive gear 32 attached to the shaft of the photoconductive drum 2, and the like.

In the second term, $\Delta\omega\cos(\omega_0 t_0+\alpha)$, of the right-hand side in Equation 1, "$\alpha$" represents a phase of the periodic variation based on the reference time when the drum position sensor 20 detects the marking 4. Then, a surface moving speed, $V_{SP}$, of the photoconductive drum 2 can be expressed by the following Equation 2.

$$V_{sp}=R\{\omega_0+\Delta\omega\cos(\omega_0 t_0+\alpha)\} \quad \text{Eq. 2}$$

where "R" represents a radius of the photoconductive drum 2.

Further, a pattern interval, $\delta P_0$, between two given toner images of the adjustment pattern 45 formed on the writing position, WP, at a constant, minute interval, $\delta t$, can be expressed by the following Equation 3.

$$\delta P_0 = V_{SP}\delta t = R\{\omega_0 + \Delta\omega \cos(\omega_0 t_0 + \alpha)\}\delta t \quad \text{Eq. 3}$$

The adjustment pattern 45 is transferred onto the intermediate transfer belt 10 after a time, T, required for the photoconductive drum 2 to be rotated by an angle, $\phi$, has elapsed. The angle, $\phi$, is formed with an imaginary line connecting between the rotation center and the writing position, WP, of the photoconductive drum 2 and an imaginary line connecting between the rotation center and the transfer position, TP, of the photoconductive drum 2.

A rotation angular speed, $\omega_\phi$, on transferring the adjustment pattern 45 onto the intermediate transfer belt 10 can be expressed by the following Equation 4.

$$\omega_\phi = \omega_0 + \Delta\omega \cos(\omega_0 t_0 + \alpha + \phi) \quad \text{Eq. 4}$$

The second term, $\Delta\omega \cos(\omega_0 t_0 + \alpha + \phi)$, of the right-hand side of Equation 4 represents a variable component having a rotation period of the photoconductive drum 2. Therefore, "$\phi$" represents a phase difference observed after a time, $T_\phi$, has elapsed from the writing of the latent image. At this time, a surface moving speed, $V_{TR}$, of the photoconductive drum 2 can be expressed by the following Equation 5:

$$V_{TR} = R\{\omega_0 + \Delta\omega \cos(\omega_0 t_0 + \alpha + \phi)\} \quad \text{Eq. 5}$$

Furthermore, the following assumptions are made that a surface moving speed of the intermediate transfer belt 10 is substantially equal to an average surface moving speed of the photoconductive drum 2, and a relation of $Vb = R\omega_0$ is satisfied.

In this case, when the surface moving speed of the photoconductive drum 2 is higher than the surface moving speed of the intermediate transfer belt 10, the pattern interval on the photoconductive drum 2 becomes shorter than when the surface moving speed of the photoconductive drum 2 is substantially equal to the surface moving speed of the intermediate transfer belt 10.

On the other hand, when the surface moving speed of the photoconductive drum 2 is lower than the surface moving speed of the intermediate transfer belt 10, the pattern interval on the photoconductive drum 2 becomes longer than when the surface moving speed of the photoconductive drum 2 is substantially equal to the surface moving speed of the intermediate transfer belt 10.

Therefore, a pattern interval, P, of the adjustment pattern 45 transferred onto the intermediate transfer belt 10 can be expressed by the following Equation 6.

$$\delta P = \delta P_0 \frac{V_b}{V_{TR}} = P_n \frac{\omega_0 + \Delta\omega\cos(\omega_0 t_0 + \alpha)}{\omega_0 + \Delta\omega\cos(\omega_0 t_0 + \alpha + \varphi)} \quad \text{Eq. 6}$$

where a relation of $P_n = R\omega_0\delta t$ is satisfied.

At this point, the variable component, $\Delta\omega$, is sufficiently small compared to the average angular speed, $\omega_0$. Therefore, the above Equation 6 can be approximated by the following Equation 7.

$$\delta P = P_n \frac{1}{\omega_0}\{\omega_0 + \Delta\omega\cos(\omega_0 t_0 + \alpha) - \Delta\omega\cos(\omega_0 t_0 + \alpha + \varphi)\} \quad \text{Eq. 7}$$

Moreover, the above Equation 7 can be converted into the following Equation 8.

$$\delta P = P_n \frac{1}{\omega_0}\{\omega_0 + 2\Delta\omega\sin(\frac{\varphi}{2})\sin(\omega_0 t_0 + \alpha + \frac{\varphi}{2})\} \quad \text{Eq. 8}$$

Equation 8 represents a pattern interval between two given toner images of the adjustment pattern 45 observed after the adjustment pattern 45 formed on the photoconductive drum 2 at a constant, minute time, $\delta t$, is transferred onto the intermediate transfer belt 10.

When the latent image of the adjustment pattern 45 is formed at a constant time interval, the latent image is written at the writing position, WP, at a constant time interval, Te, different from the minute interval, $\delta t$. Further, the latent image is transferred onto the intermediate transfer belt 10, and then a passing timing of the adjustment pattern 45 is detected with the light-sensitive element 42 provided above the intermediate transfer belt 10.

Thus, a detection timing when the adjustment pattern 45 on the intermediate transfer belt 10 is detected is determined. Until this step, the timing when the drum position sensor 20 detects the marking 4 is employed as the reference timing.

Where zero represents a reference point at which the adjustment pattern 45 written at the reference timing is detected with the light-sensitive element 42, a pattern interval, PN, from the reference point to an Nth pattern written at a time, TeN (N represents a natural number), can be expressed by the following Equation 9.

$$\begin{aligned} P_N &= \int_0^{TeN} \delta P dt_0 \\ &= \int_0^{TeN} R\{\omega_0 + 2\Delta\omega\sin(\frac{\varphi}{2})\sin(\omega_0 t_0 + \alpha + \frac{\varphi}{2})\} dt_0 \end{aligned} \quad \text{Eq. 9}$$

The following Equation 10 can be obtained from the above Equation 9.

$$\begin{aligned} P_N &= R\omega_0 TeN - 2R\frac{\Delta\omega}{\omega_0}\sin(\frac{\varphi}{2})\cos(\omega_0 TeN + \alpha + \frac{\varphi}{2}) + C \\ &= R\omega_0 TeN + 2R\frac{\Delta\omega}{\omega_0}\sin(\frac{\varphi}{2})\cos(\omega_0 TeN + \alpha + \frac{\varphi}{2} + \pi) + C \end{aligned} \quad \text{Eq. 10}$$

where the constant, C, in the above Equation 10 can be expressed by the following Equation 11.

$$C = 2R\frac{\Delta\omega}{\omega_0}\sin(\frac{\varphi}{2})\cos(\alpha + \frac{\varphi}{2}) \quad \text{Eq. 11}$$

Thus, toner images of the adjustment pattern 45 are formed on the intermediate transfer belt 10 at a pattern interval expressed by Formula 10, and are detected with the light-sensitive element 42.

As described above, a detected result of the adjustment pattern 45 is stored in the RAM 60 as the pattern detection data. Then, data of the surface moving speed of the intermediate transfer belt 10 included in the pattern detection data are converted into data of the position thereof.

Incidentally, the first term of the right-hand side in Equation 10 corresponds to a slope of the pattern detection data, and is used in detecting a magnification error.

For the pattern variation data, an amplitude and a phase of a variable component occurring in a rotation period of the photoconductive drum 2 are calculated by the above-described quadrature detection processing. The variable component corresponds to the first term of the right-hand side in Equation 10.

The amplitude, A, of the variable component can be expressed by the following Equation 12. The phase, B, of the variable component can be expressed by the following Equation 13. Incidentally, the third term, C, of the right-hand side in Equation 10 represents a constant deviation, and serves to shift a zero level of the periodical variation represented by the second term thereof to the amplitude direction. Therefore, the third term, C, has no effect on the amplitude and the phase detected through quadrature conversion.

$$A = 2R\frac{\Delta\omega}{\omega_0}\sin\left(\frac{\varphi}{2}\right) \quad \text{Eq. 12}$$

$$B = \alpha + \frac{\varphi}{2} + \pi \quad \text{Eq. 13}$$

In this regard, the variable component having a rotation period of the photoconductive drum 2 results from a variation in rotation angular speed of the photoconductive drum 2 represented by the second term of the above Equation 1. Therefore, a drive control correction value to correct the variation in rotation angular speed of the photoconductive drum 2 is set so as to be an inverse number of the second term of Equation 1.

Further, based on the amplitude and the phase calculated by the quadrature detection processing, that is, the amplitude and the phase expressed by Equations 12 and 13, respectively, a detected value of the periodic variation of the photoconductive drum 2 is represented by dividing the amplitude by $2\times R\times \sin(\phi/2)/\omega_0$, and delaying the phase by $\phi/2+\pi$ Therefore, a correction reference signal for use in correcting the periodic variation of the photoconductive drum 2 is preferably corrected through dividing the amplitude calculated from Equation 12 by $2\times R\times\sin(\phi/2)/\omega_0$, and delaying the phase calculated from Equation 13 by $\phi/2$. At this time, specifically, the phase calculated from Equation 13 is once delayed by $\phi/2+\pi$ and then is further delayed by $\pi$. As a result, the phase calculated from Equation 13 is delayed by $\phi/2$.

Values for use in correcting the correction reference signal may be calculated in advance from the configuration of the image forming mechanisms 300. Thereby, the rotation angular speed of the drive motor 33 is controlled so as to cancel the variation in rotation angular speed occurring in the rotation period of the photoconductive drum 2. Thus, the photoconductive drum 2 may be rotated at a constant rotation angular speed.

Incidentally, the controller 37 of FIG. 2 detects a rotation angular displacement of the photoconductive drum 2, based on an output pulse count of the rotary encoder 35 serving as a position control mechanism. At this time, a target value of the rotation angular displacement is set in the target value output unit 38.

Then, a drive control correction value to correct the rotation angular displacement of the photoconductive drum 2 is preferably set so as to cancel the variable component, based on a rotation angle, θ, of the photoconductive drum 2. The rotation angle, θ, can be expressed by the following Equation 14 that is obtained by integrating Equation 1.

$$\theta = \omega_0 t_0 + \frac{\Delta\omega}{\omega_0}\sin(\omega_0 t_0 + \alpha) + C_0 \quad \text{Eq. 14}$$

In addition, the following Equation 15 is obtained by converting the second term of the right-hand side of Equation 10 into a sine function.

$$P_N = R\omega_0 TeN + 2R\frac{\Delta\omega}{\omega_0}\sin\left(\frac{\varphi}{2}\right)\sin\left(\omega_0 TeN + \alpha + \frac{\varphi}{2} + \frac{3}{2}\pi\right) + C \quad \text{Eq. 15}$$

Then, the drive control correction value to correct the rotation angular displacement of the photoconductive drum 2 is set so as to be an inverse number of the second term of Equation 14. Therefore, the drive control correction value is obtained through dividing the amplitude calculated from Equation 12 by $2\times R\times\sin(\phi/2)$ and delaying the phase calculated from Equation 13 by $(\phi+3\pi)/2$.

In the above description, first, the adjustment pattern 45 is written onto the photoconductive drum 2 based on a timing when the drum position sensor 20 detects the marking 4. Then, a passing timing of the adjustment pattern 45 is determined based on a reference position at which the adjustment pattern 45 having been transformed on the intermediate transfer belt 10 is detected with the light-sensitive element 42.

However, the surface moving speed of the intermediate transfer belt 10 may be unstable. Further, the average surface moving speed thereof may be uncertain due to expansion or shrink in diameter of the drive support roller 8 that is caused by temperature variation. In such cases, an error may be caused in detecting the above reference position.

Then, a reference mark is preferably formed as a reference point of pattern detection separately from the adjustment pattern 45. The passing timings of toner images of the adjustment pattern 45 formed on the intermediate transfer belt 10 are determined based on a detection result of the reference mark. At this time, a phase relation between a writing timing of the reference mark and a detection timing of the marking 4 detected with the drum position sensor 20 should be reflected to a phase value for use in the drive control correction.

According to the present example embodiment, the drive control correction value to correct a variation in surface moving speed of the photoconductive drum 2 may be calculated with relatively high accuracy based on the pattern detection data, regardless of the relative positional relation between the writing position, WP, and the transfer position, TP, on the photoconductive drum 2.

In this regard, as performed in a conventional art, when a drive control correction value is calculated by using 180°, which is different from the actual angle, as a phase difference angle, φ, between the writing position, WP, and the transfer position, TP, an error may be caused in the drive control of the photoconductive drum 2. The error can be calculated from a difference between two pattern variation values that are obtained by substituting each of an actual phase-difference angle and 180° into "φ" in Equation 10.

Figure 10:
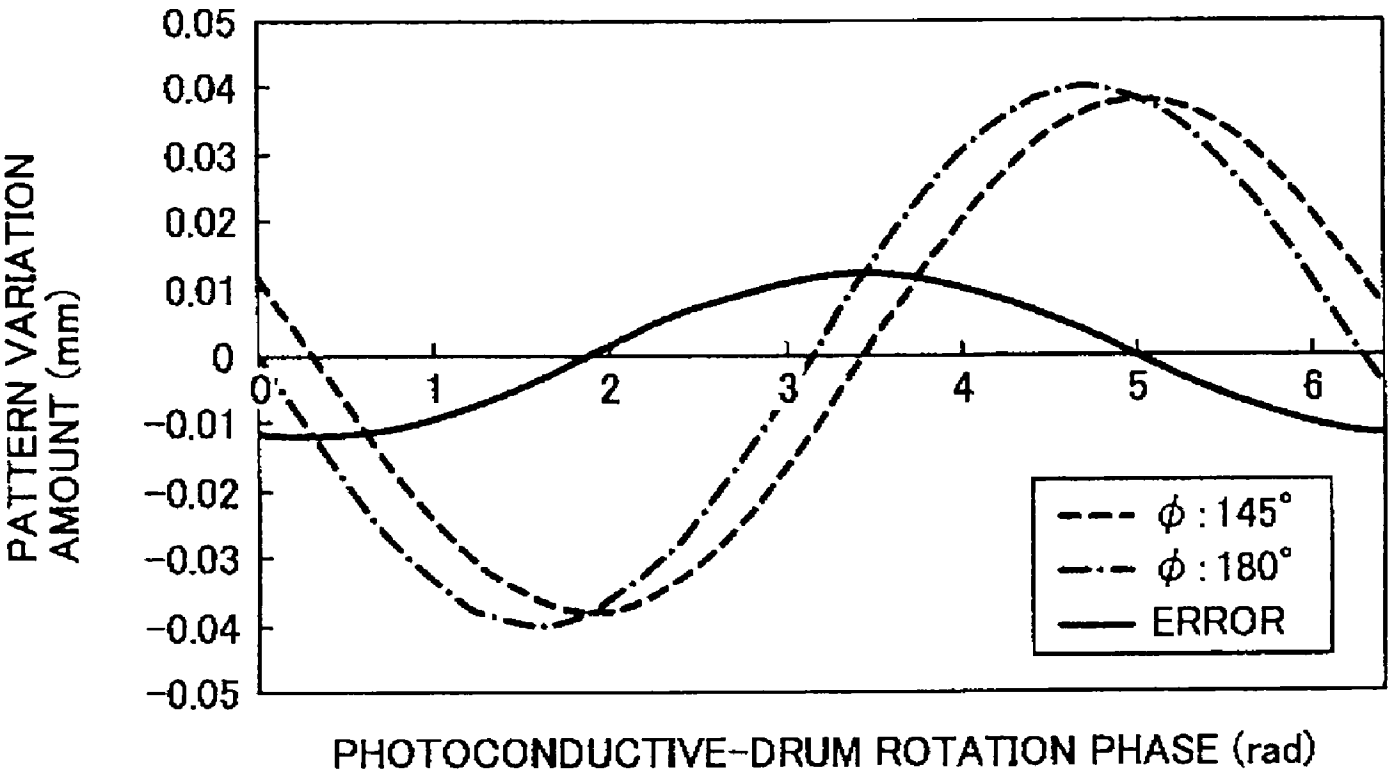
FIG. 10 is a graph illustrating difference in drive control correction values obtained when a phase difference angle between a latent-image writing position and a transfer position on the photoconductive drum is set to 145° and 180°.

FIG. 10 illustrates a graph obtained when each of 2.53 rad (i.e. 145°) and 3.14 rad (i.e. 180°) is substituted into "φ" in Equation 10. In this case, a radius, R, of the photoconductive drum 2 is set to 20 mm, a variation rate of rotation angular speed, $\Delta\omega/\omega_0$, is set to 0.1%, and "α" is set to zero. In FIG. 10, "ERROR" represents the difference between pattern variation values that are obtained by substituting each of 2.53 rad and 3.14 rad into "$\phi$" in Equation 10.

As illustrated in FIG. 10, when the phase difference angle between the writing position, WP, and the transfer position, TP, is deviated by 35° from 180°, the small variation rate of 0.1% in rotation angular speed may cause a difference of up to approximately 12 μm in pattern variation amount. The difference indicates an error in the drive control correction.

However, according to the present example embodiment, the error may be effectively suppressed as described above, and therefore the drive control correction may be performed with relatively high accuracy.

In the above, description has been given to the variation in surface moving speed of the photoconductive drum 2 that may be caused by the variable component in rotation angular speed of the photoconductive drum 2 having a rotation period of the photoconductive drum 2. However, for a variation in surface moving speed of the photoconductive drum 2 that may be caused by other variable components, a drive control correction value may be calculated in a similar manner to the above.

For example, the drive transmission mechanism may include a timing belt stretched over a drive motor shaft pulley and a photoconductive drum shaft pulley. In this case, first, a phase difference angle, $\phi$, between the writing position, WP, and the transfer position, TP, of the photoconductive drum 2 is converted into a phase difference angle, $\phi_{tb}$, on a rotation period of the timing belt. Then, similar processing to the above may be performed with an actual rotation period, $\omega_{tb}$, of the timing belt and the converted phase difference angle, $\phi_{tb}$, of the timing belt.

In this case, the timing belt is preferably provided with a marking and a drum position sensor to determine a reference timing of the rotation of the timing belt. However, unless an inappropriate slippage occurs between the photoconductive drum shaft pulley and the timing belt, the reference timing of the rotation of the timing belt may be set based on a detection timing of a marking provided at the photoconductive drum shaft pulley.

Variation Example 1

Next, a variation example (hereinafter, "variation example 1") of the present example embodiment is described.

Figure 11:
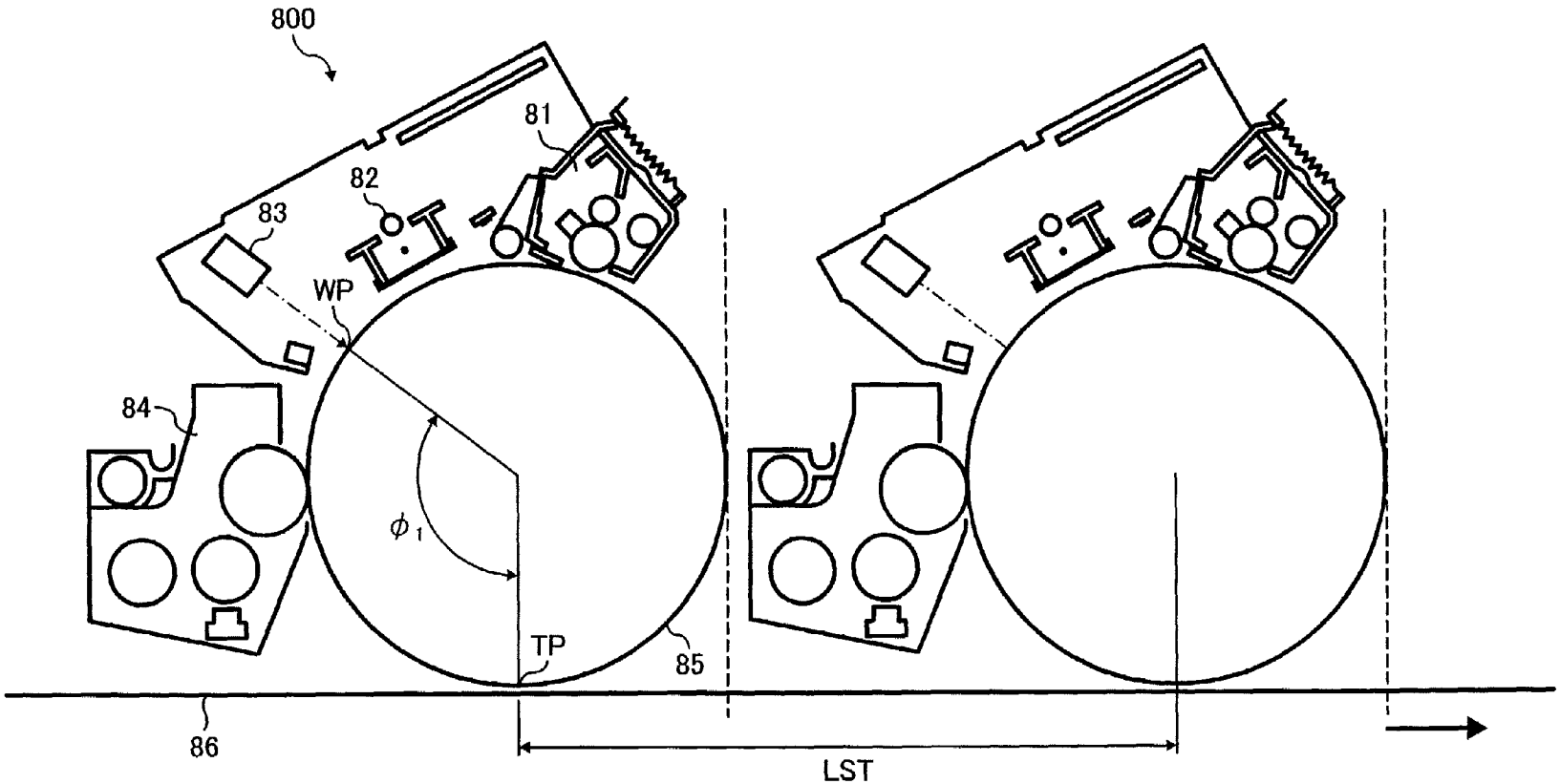
FIG. 11 is an explanatory diagram illustrating image forming mechanisms 800 according to a variation example 1 of the example embodiment of the present invention.

FIG. 11 is an explanatory diagram illustrating image forming mechanisms 800 of the variation example 1.

Each of the image forming mechanisms 800 of the present variation example 1 employs a photoconductive drum 85 having a relatively larger diameter to obtain high durability in a photoconductive layer of the photoconductive drum 85. The photoconductive drum 85 is surrounded by a cleaner 81, a charger 82, an optical writing unit 83, and a developer 84.

The cleaner 81, the charger 82, the optical writing unit 83, and the developer 84 are arranged on a left side relative to the photoconductive drum 85 in FIG. 11. Thereby, a relatively short interval can be obtained between the adjacent image forming mechanisms 800. Further, a relatively smaller size can be achieved for a lateral size of the image forming mechanisms 800 as a whole.

Thus, the image forming mechanisms 800 have an angle significantly deviated from 180° as a phase difference angle, $\phi_1$, between a writing position, WP, and a transfer position, TP, on the photoconductive drum 85. In the variation example 1, $\phi_1$, is set to 120°. When the image forming apparatus 200 employs the image forming mechanisms 800 instead of the image forming mechanisms 300, the drive control correction value may also be obtained with relatively high accuracy by performing a similar correction operation to the above-described correction operation.

Variation Example 2

Next, another variation example (hereinafter, "variation example 2") of the present example embodiment is described.

Figure 12:
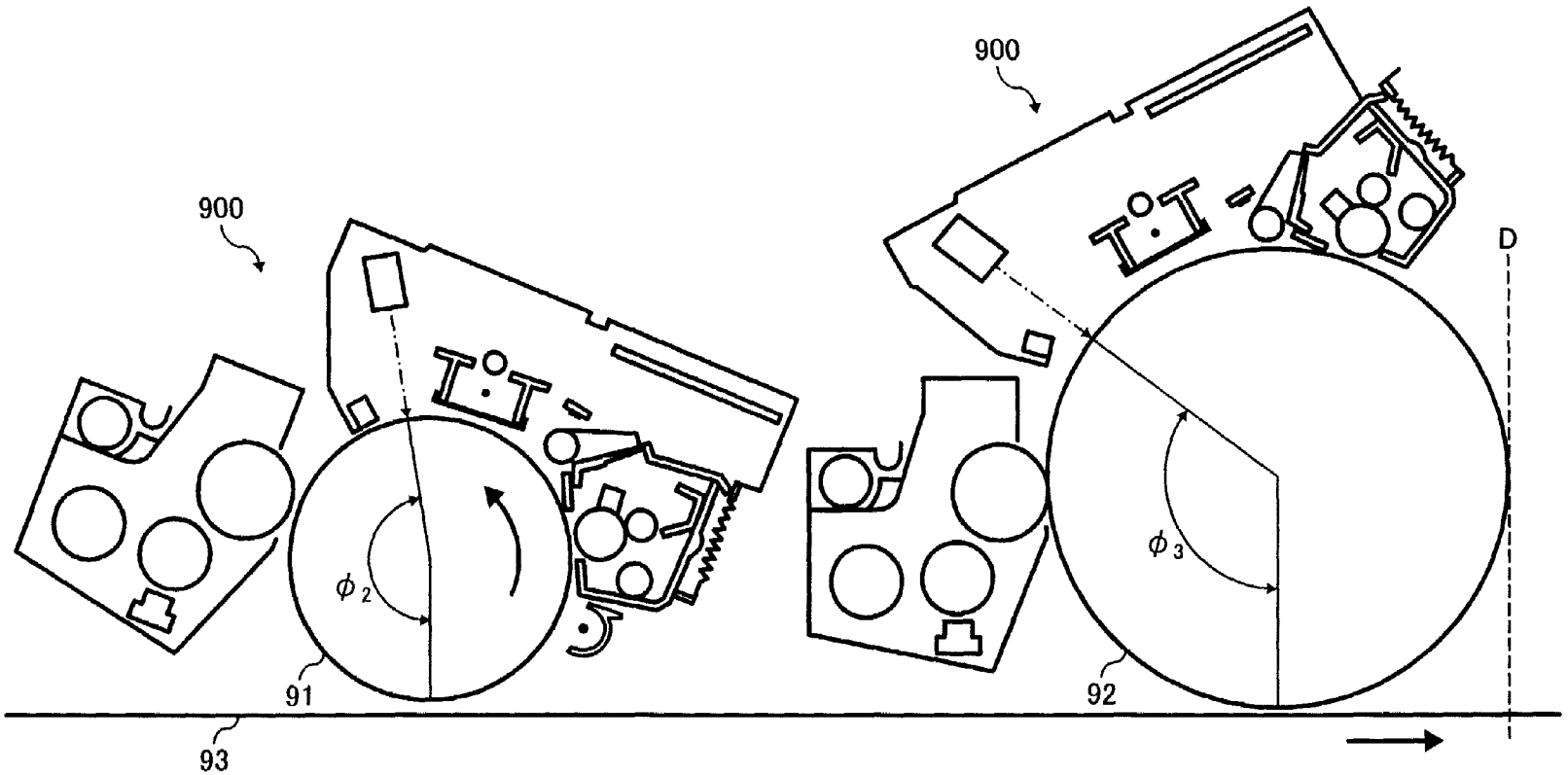
FIG. 12 is an explanatory diagram illustrating image forming mechanisms 900 according to a variation example 2 of the example embodiment of the present invention.

FIG. 12 is an explanatory diagram illustrating image forming mechanisms 900 of the variation example 2.

According to the variation example 2, the image forming mechanisms 900 are arranged in tandem along the intermediate transfer belt 10. At least one of the image forming mechanisms 900 has a different phase-difference angle between a writing position, WP, and a transfer position, TP, from the others thereof.

Generally, monochrome images are more frequently output in an image forming apparatus than color images. Therefore, a photoconductive drum for black image is more frequently used for image formation than any of photoconductive drums for other color images.

Then, the image forming mechanisms 900 of the variation example 2 employ a photoconductive drum 92 for black image having a relatively large diameter compared to any of photoconductive drums 91 for other color images. Thereby, relatively high durability may be achieved for the image forming mechanisms 900.

Further, since the photoconductive drum 92 for black image has a relatively large diameter, various surrounding devices are arranged so that each working point thereof onto the photoconductive drum 92 is positioned on the side of photoconductive drum 92 (i.e. the left side in FIG. 12) relative to a tangent plane, D, of the photoconductive drum 92 perpendicular to the surface of the intermediate transfer belt 93, similar to the variation example 1. Thereby, a relatively small size may be achieved for a lateral size of the image forming mechanisms 900 as a whole.

In addition, when similar materials are used for photoconductive layers of the photoconductive drums 91 and 92, similar phenomena are observed in toner transfer and movement of electric charge in the photoconductive layers. Accordingly, distances among surrounding units of the photoconductive drum 92 are preferably adjusted so as to correspond to distances among surrounding units of each of the photoconductive drums 91.

Then, a phase difference angle, $\phi_3$, between a writing position, WP, and a transfer position, TP, on the photoconductive drum 92 for black image is configured to be different from a phase difference angle, $\phi_2$, on between a writing position, WP, and a transfer position, TP, on the photoconductive drum 91 for other color image.

The above-described correction operation is independently performed in each of the image forming mechanisms 300. Therefore, when the image forming apparatus 200 employs the image forming mechanisms 900 instead of the image forming mechanisms 300, the drive control correction value may also be obtained with relatively high accuracy by performing a similar correction operation to the above-described correction operation.

Variable Example 3

Next, still another variation example (hereinafter, "variation example 3") of the present example embodiment is described.

Figure 13:
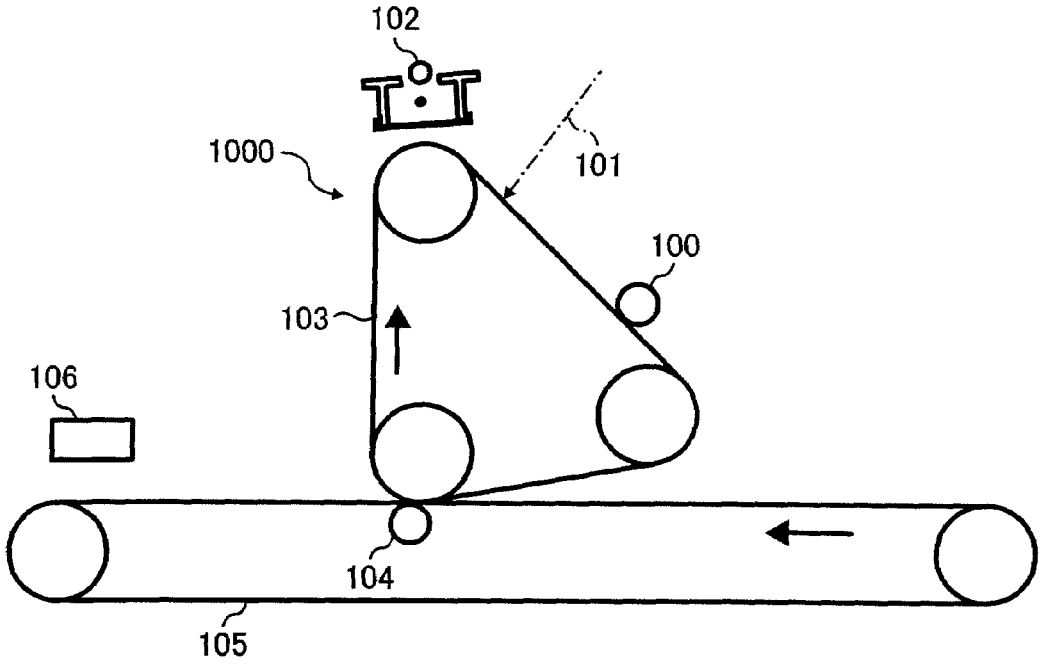
FIG. 13 is an explanatory diagram illustrating an image forming mechanism 1000 according to a variation example 3 of the example embodiment of the present invention.

FIG. 13 is an explanatory diagram illustrating an image forming mechanism 1000 of the variation example 3.

The present example embodiment and the variation examples 1 and 2 thereof describe the cases where drum-shaped photoconductors are employed as image carriers. However, an image carrier to be used in the image forming apparatus 200 is not limited to such drum-shaped photoconductors.

As described above, a surface moving member including a latent-image writing position, WT, and a transfer position, TP, may be employed as the image carrier. For example, as described below, an endless-belt-shaped photoconductor may be employed as the image carrier.

According to the variation example 3, a photoconductive belt 103 is stretched over three support rollers. One of the three support rollers is configured as a drive roller. The photoconductive belt 103 is endlessly driven with the drive roller in a clockwise direction in FIG. 13, similar to an intermediate transfer belt 105. The photoconductive belt 103 is in contact with the intermediate transfer belt 105 at a portion where the photoconductive belt 103 is supported with the lowest one of the three support rollers.

The photoconductive belt 103 is surrounded with a charger 102, an optical writing unit (not illustrated), a developer 100, a transfer roller 104. The charger 102 charges the photoconductive belt 103 at a given electric potential. The optical writing unit emits a laser light 101 according to an image signal to form a latent image on a surface of the photoconductive belt 103. The developer 100 develops the latent image with charged toner to form a toner image on the photoconductive belt 103.

The transfer roller 104 transfers the toner image from the photoconductive belt 103 onto the intermediate transfer belt 105. The transfer roller 104 is arranged on an inner side of the photoconductive belt 103 so as to oppose to the lowest support roller of the photoconductive belt 103.

A pattern sensor 106 is provided above the intermediate transfer belt 105, and detects an adjustment pattern formed on the intermediate transfer belt 105.

For the photoconductive belt 103 having a configuration as described above, a variation in surface moving speed thereof may be caused by eccentricity of the drive roller, deviation in thickness of the photoconductive belt 103, etc. In this regard, the variation in surface moving speed occurring in a rotation period of the photoconductive belt 103 may be corrected with a drive control correction value in a similar manner as described above.

The drive control correction value is calculated based on a rotation angular speed, $\omega_{ob}$, and a phase difference rotation angle, $\phi_{ob}$, in the rotation period of the photoconductive belt 103 between a writing position, WP, of a laser light 101 and a transfer position, TP, at which the intermediate transfer belt 10 is in contact with the photoconductive belt 103. Parameters corresponding to the radius, R, and the rotation angular speed, $\omega$, of the photoconductive drum 2 as described above can be obtained from a circumferential length and a surface moving speed of the photoconductive belt 103.

Thus, according to the present example embodiment including the variation examples 1, 2, and 3, the drive control correction value may be calculated with relatively high accuracy at any phase difference angle, $\phi$, between the writing position, WP, and the transfer position, TP. Therefore, the units surrounding the photoconductive drum 2 may be arranged so as to significantly deviate the phase difference angle, $\phi$, from 180°. Such a configuration in which the phase difference angle, $\phi$, is significantly deviated from 180° may provide advantages as follows.

Incidentally, a conventional configuration where the phase difference angle, $\phi$, is set to 180° is subject to a variation in surface moving speed of the photoconductive drum 2 with respect to positional displacement of image. For example, when a variation in rotation angular speed occurring in a rotation period of the photoconductive drum 2 becomes maximum at the writing position, WP, an adjustment pattern is formed near the writing position, WP, at a larger interval than a target interval.

Further, when the adjustment pattern reaches the transfer position, TP, and the phase difference angle, $\phi$, becomes 180°, the variation in rotation angular speed occurring in the rotation period of the photoconductive drum 2 becomes minimum. Thus, the adjustment pattern is transferred onto the intermediate transfer belt 10 at a timing when the surface moving speed of the photoconductive drum 2 is minimum relative to the surface moving speed of the intermediate transfer belt 10. Thereby, the adjustment pattern is formed on the intermediate transfer belt 10 at a further larger interval than the target interval.

On the other hand, the positional displacement of image becomes smaller as the phase difference angle, $\phi$, is more deviated from 180°. According to the present example embodiment, the phase difference angle, $\phi$, can be configured to be significantly deviated from 180°. Therefore, the positional displacement of image may be suppressed.

Another advantage of the above configuration is described as follows.

When the image forming apparatus 200 illustrated in FIG. 1 is taken as an example, the image forming apparatus 200 is provided with the secondary transfer roller 13 on the way of the sheet conveyance path to convey a recording sheet from the lower portion to the upper portion of the image forming apparatus 200 in a relatively short distance. In this case, the optical writing unit 1 should be arranged under the image forming mechanisms 300, as illustrated in FIG. 1. However, if the phase difference angle, $\phi$, is set to 180°, accumulation of scattered toner on the exit lens might disturb appropriate latent image formation.

Then, in the image forming apparatus 200 of the present example embodiment, the phase difference angle, $\phi$, is set to 145° so that the lens surface of the exit lens is inclined relative to a horizontal plane. Thus, the accumulation of scattered toner on the exit lens may be suppressed, thereby achieving a stable latent image formation.

In addition to the above advantages, the advantages described for the variation examples 1, 2, and 3, may be obtained by employing the configuration where the phase difference angle, $\phi$, is significantly deviated from 180°.

As described above, in the image forming apparatus 200 according to the present example embodiment, a latent image is formed on a surface of the photoconductive drum 2 serving as an image carrier having a moving surface. The latent image is developed with toner to form a toner image, and the toner image is transferred onto the intermediate transfer belt 10 serving as a surface moving member. The toner image on the intermediate transfer belt 10 is transferred onto a sheet serving as a recording member. Thus, the toner image is formed on the recording sheet.

The image forming apparatus 200 includes the drive control mechanism to control the drive of the photoconductive drum 2 so that a rotation angular speed, $\omega$, of the photoconductive drum 2 matches a target rotation angular speed thereof.

The image forming apparatus 200 also includes the pattern sensor 40 serving as the pattern detection mechanism. The pattern sensor 40 detects a plurality of toner images of the adjustment pattern 45 formed along the surface moving direction of the intermediate transfer belt 10.

The image forming apparatus 200 further includes the correction mechanism to correct the target rotation angular speed of the photoconductive drum 2, based on a detection result of the adjustment pattern 45 detected with the pattern sensor 40. In the correction mechanism, first, an amplitude and a phase of a variable component in pattern interval (i.e. pattern variation data) indicating a periodic variation in surface moving speed of the photoconductive drum 2 are calculated based on the pattern detection data detected with the pattern sensor 40.

Then, the amplitude of the pattern variation data is divided by $2\times R\times\sin(\phi/2)\omega_0$ and the phase thereof is delayed by $\phi/2$ to obtain a correction value. At this time, "$\omega_0$" represents an average rotation angular speed of the photoconductive drum 2, and "R" represents a rotation radius of the photoconductive drum 2. Further, "$\phi$" represents a phase difference angle formed with an imaginary line connecting between the rotation center and the writing position, WP, of the photoconductive drum 2 and an imaginary line connecting between the rotation center and the transfer position, TP, of the photoconductive drum 2.

Based on the correction value, the correction mechanism corrects the target rotation angular speed of the photoconductive drum 2.

According to the above configuration, regardless of the phase difference angle, $\phi$, the correction value may be accurately calculated based on the detection result of the adjustment pattern 45. That is, the correction value may cancel an error caused by the periodic variation in rotation angular speed of the photoconductive drum 2. Therefore, the positional relation of the writing position, WP, and the transfer position, TP is not limited by consideration for calculating an appropriate correction value. Thereby, increased flexibility may be obtained for the arrangement of the units in the image forming apparatus 200.

Further, as described above, when the position control system including the rotary encoder 35 is employed, the target rotation angular displacement may be corrected with a correction value obtained by the amplitude of the pattern variation data by $2\times R\times\sin(\phi/2)$ and delaying the phase of the pattern variation data by $(\phi+3\pi)/2$.

According to the present example embodiment, the correction mechanism calculates the amplitude and the phase of pattern variation data by the quadrature detection processing. Thereby, the amplitude and the phase of pattern variation data may be calculated based on a relatively small+ amount of pattern detection data compared to a method of detecting a zero cross point or a peak value of variable component.

In employing the quadrature detection processing, the adjustment pattern 45 is preferably formed by forming a latent image at a constant time interval over a range on the photoconductive drum 2 having a natural-number multiple length of a circumferential length of the photoconductive drum 2, developing the latent images with toner, and transferring the toner images on the surface of the intermediate transfer belt 10. Thereby, the correction value may be obtained with relatively high accuracy.

In employing the quadrature detection processing, the adjustment pattern 45 is also preferably formed by forming a latent image at a constant time interval over a range on the photoconductive drum 2 having a common multiple length between a circumferential length of the photoconductive drum 2 and a circumferential length of the drive support roller 8, developing the latent images with toner, and transferring the toner images on the surface of the intermediate transfer belt 10. Thereby, the correction value may be obtained with relatively high accuracy.

In employing the quadrature detection processing, further, the adjustment pattern 45 is preferably formed by forming a latent image at a constant time interval on the photoconductive drum 2 at a rate so that 4NP toner images are formed for a period of a periodic variation in surface moving speed of the photoconductive drum 2, developing the latent images with toner, and transferring the toner images on the surface of the intermediate transfer belt 10. Thereby, the amplitude and the phase of the pattern variation data may be obtained with relatively high detection sensitivity.

In addition, the reference mark may be formed separately from the adjustment pattern 45 and detected with the pattern sensor 40. Further, time data that have elapsed from detection of the reference mark to each detection of the toner images of the adjustment pattern 45 may be employed as the detection data.

The detection timing of the marking provided on the shaft of the photoconductive drum 2 may be employed to determine a phase relation between the pattern detection data obtained from the detection result of the adjustment pattern 45 and the rotation angle of the photoconductive drum 2. However, in this case, an error may be caused by a variation in surface moving speed of the intermediate transfer belt 10.

Then, through detecting the reference mark formed as described above, the phase relation between the pattern detection data and the rotation angle of the photoconductive drum 2 may be determined with relatively high accuracy.

According to the present example embodiment, the image forming apparatus 200 includes the surface-moving-member drive control mechanism to control drive of the drive support roller 8 based on rotation data of at least one of the drive support roller 8 and the support rollers 7, 11, and 12. The surface-moving-member drive control mechanism also controls the drive of the drive support roller 8 so that the intermediate transfer belt 10 configured as an endless belt stretched over the drive support roller 8 and the support rollers 7, 11, and 12 moves at a constant speed.

In detecting the adjustment pattern 45 formed on the intermediate transfer belt 10, detection accuracy of the pattern variation data significantly depends on the variation in surface moving speed of the intermediate transfer belt 10. According to the present example embodiment, the variation of the intermediate transfer belt 10 may be suppressed, and therefore the pattern variation data may be obtained with relatively high accuracy.

As described with the variation example 3, when the photoconductive belt 103 is employed as an image carrier, the correction mechanism employs, as the average rotation angular speed, $\omega_0$, and the rotation radius, R, an average rotation angular speed and a rotation radius that are obtained from the circumferential length and the average surface moving speed of the photoconductive belt 103 by converting the belt-shape of the photoconductive belt 103 into a cylindrical shape.

Thus, even in employing the photoconductive belt 103 having relatively high flexibility in layout compared to the photoconductive drum 2, the periodic variation in surface moving speed of the photoconductive belt 103 may be suppressed, and therefore the positional displacement of image may be suppressed.

In employing the photoconductive belt 103, deviation in thickness along the circumferential direction thereof may cause a variation in surface moving speed thereof. The variation in surface moving speed may be determined based on the detection result of the adjustment pattern 45, and therefore may be corrected in a similar manner to the above correction operation.

On the other hand, the photoconductive drum 2 having a cylindrical shape has relatively high stiffness to load change caused by surrounding devices, such as the developer, the transfer roller, and the cleaner, compared to the belt shaped photoconductor. Therefore, image formation may be performed with relatively high accuracy.

As described with the variation example 1, the surrounding devices to form a toner image on the photoconductive drum 85 are arranged so that each working point of the devices onto the photoconductive drum 2 is positioned on the side of the photoconductive drum 85 (i.e. the left side in FIG. 11) relative to a tangent plane of the photoconductive drum 85 perpendicular to the surface of the intermediate transfer belt 86.

Thereby, the image forming apparatus 200 may be effectively downsized. In particular, when the plurality of the photoconductive drums 85 are arranged in tandem in the image forming apparatus 200, a pitch, LST, between the photoconductive drums 85 may be shorten, and thereby the image forming apparatus 200 may be further effectively downsized.

As described with the variation example 2, the image forming apparatus 200 may have a configuration in which the plurality of the photoconductive drums are arranged along the surface moving direction of the intermediate transfer belt 93, and a circumferential length of at least one of the plurality of the photoconductive drums is different from the other ones thereof. Thereby, a more frequently used one of the photoconductive drums may have a relatively longer circumferential length than a less frequently used one thereof.

As described with the present example embodiment, the optical writing unit 8 serving as the latent image writing mechanism is arranged so as to write a latent image by emitting a light obliquely from below the photoconductive drum 2. Thus, accumulation of scattered toner onto the exit lens may be suppressed, thereby achieving a stable latent image formation.

In the above description of the present example embodiment, the image forming apparatus 200 is explained with referring to the tandem-type image forming apparatus employing the intermediate transfer method. However, the image forming apparatus 200 may be configured as a tandem-type image forming apparatus employing a direct transfer method.

Further, the image forming apparatus 200 may be configured as an image forming apparatus including only one image carrier, such as a photoconductive drum or a photoconductive belt. For example, in a monochrome image forming apparatus, no positional displacement between color images occurs, but a variation in surface moving speed of the photoconductive drum 2 may expand or contract a portion of image, thereby causing image distortion.

However, such image distortion may be suppressed through correcting the variation in surface moving speed of the image carrier by the above-described correction method. Thus, the above-described correction method may be effectively applied to the monochrome image forming apparatus.

This invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Numerous additional modifications and variations are possible in light of the above teachings. It is therefore to be understood that within the scope of the appended claims, the disclosure of this patent specification may be practiced otherwise than as specifically described herein.

What is claimed is:

1. An image forming apparatus, comprising:

a latent image carrier having a moving surface on which a latent image is formed;

a drive control mechanism configured to control a drive of the latent image carrier so as to match a rotation angular speed of the latent image carrier with a target rotation angular speed thereof;

a surface moving member having a moving surface on which an adjustment pattern for use in controlling the drive of the latent image carrier is formed;

an image forming mechanism configured to develop the latent image with toner and transfer a resultant toner image on the moving surface of the surface moving member so as to form the adjustment pattern along a surface moving direction thereof;

a pattern sensor configured to detect the adjustment pattern; and a correction mechanism configured to correct the target rotation angular speed of the latent image carrier based on an amplitude and a phase of a variable component in a pattern interval of the adjustment pattern detected with the pattern sensor, wherein the correction mechanism corrects the target rotation angular speed of the latent image carrier by superposing a correction value on an uncorrected value of the target rotation angular speed, the correction value being obtained by calculating the amplitude and the phase of the variable component in the pattern interval of the adjustment pattern indicating a periodic variation in a surface moving speed of the latent image carrier from the detection data of the adjustment pattern, dividing the amplitude of the variable component by $2\times R\times \sin(\phi/2)/\omega_0$, and delaying the phase of the variable component by $\phi/2$, where "$\omega_0$" represents an average rotation angular speed of the latent image carrier, "R" represents a rotation radius of the latent image carrier, and "$\phi$" represents an angle formed with two imaginary lines connecting a rotation center of the latent image carrier to each of a latent image writing position and a transfer position on the surface of the latent image carrier on an imaginary plane perpendicular to a rotation axis of the latent image carrier.

2. The image forming apparatus according to claim 1, wherein the correction mechanism employs quadrature detection processing to calculate the amplitude and the phase of the variable component in the pattern interval of the adjustment pattern, based on an in-phase component substantially similar in period and phase to a variation component in the surface moving speed of the latent image carrier, and an orthogonal component substantially similar in period to and substantially orthogonal in phase to the variation component in the surface moving speed of the latent image carrier.

3. The image forming apparatus according to claim 1, further comprising:

a plurality of support rollers configured to support the latent image carrier;

wherein the latent image carrier is configured as an endless belt looped over the plurality of support rollers, and wherein the correction mechanism employs, as the average rotation angular speed, $\omega_0$, and the rotation radius, R, an average rotation angular speed and a rotation radius obtained by converting an average surface moving speed and a circumferential length of the latent image carrier when the latent image carrier has a cylindrical shape.

4. An image forming apparatus, comprising:

a latent image carrier having a moving surface on which a latent image is formed;

a drive control mechanism configured to control a drive of the latent image carrier so as to match a rotation angular speed of the latent image carrier with a target rotation angular speed thereof;

a surface moving member having a moving surface on which an adjustment pattern for use in controlling the drive of the latent image carrier is formed;

an image forming mechanism configured to develop the latent image with toner and transfer a resultant toner image on the moving surface of the surface moving member so as to form the adjustment pattern along a surface moving direction thereof;

a pattern sensor configured to detect the adjustment pattern; and a correction mechanism configured to correct the target rotation angular speed of the latent image carrier based on an amplitude and a phase of a variable component in a pattern interval of the adjustment pattern detected with the pattern sensor, wherein the correction mechanism corrects the target rotation angular speed of the latent image carrier by superposing a correction value on an uncorrected value of the target rotation angular speed, the correction value being obtained by calculating the amplitude and the phase of the variable component in the pattern interval of the adjustment pattern indicating a periodic variation in a surface moving speed of the latent image carrier from the detection data of the adjustment pattern, dividing the amplitude of the variable component by $2\times R\times \sin(\phi/2)$, and delaying the phase of the variable component by $(\phi+3\pi)/2$, where "$\omega_0$" represents an average rotation angular speed of the latent image carrier, "R" represents a rotation radius of the latent image carrier, and "$\phi$" represents an angle formed with two imaginary lines connecting a rotation center of the latent image carrier to each of a latent image writing position and a transfer position on the surface of the latent image carrier on an imaginary plane perpendicular to a rotation axis of the latent image carrier.

5. The image forming apparatus according to claim 4, wherein the correction mechanism employs quadrature detection processing to calculate the amplitude and the phase of the variable component in the pattern interval of the adjustment pattern, based on an in-phase component substantially similar in period and phase to the variation component in the surface moving speed of the latent image carrier, and an orthogonal component substantially similar in period to and substantially orthogonal in phase to the variation component in the surface moving speed of the latent image carrier.

6. The image forming apparatus according to claim 4, further comprising:

a plurality of support rollers configured to support the latent image carrier;

wherein the latent image carrier is configured as an endless belt looped over the plurality of support rollers, and wherein the correction mechanism employs, as the average rotation angular speed, $\omega_0$, and the rotation radius, R, an average rotation angular speed and a rotation radius obtained by converting an average surface moving speed and a circumferential length of the latent image carrier when the latent image carrier has a cylindrical shape.

7. The image forming apparatus according to claim 4, further comprising:

a plurality of support rollers configured to support the surface moving member;

wherein the adjustment pattern is provided by forming latent images at a substantially constant time interval on the surface of the latent image carrier over a range having a common multiple length between circumferential lengths of the latent image carrier and at least one of the plurality of support rollers contributing to a periodic variation in the pattern interval of the adjustment pattern, developing the latent images with toner, and transferring resultant toner images onto the surface of the surface moving member.

8. The image forming apparatus according to claim 4, wherein the adjustment pattern is provided by forming latent images at a substantially constant time interval on the surface of the latent image carrier at a rate at which 4N toner images, where N represents a natural number, are formed for a period of a periodic variation in a surface moving speed of the latent image carrier, developing the latent images with toner, and transferring resultant toner images onto the surface of the surface moving member.

9. The image forming apparatus according to claim 4, further comprising:

a plurality of support rollers configured to support the surface moving member, the plurality of support rollers including a drive support roller to drive the surface moving member; and a drive control mechanism configured to control drive of the drive support roller based on rotation data of at least one of the plurality of support rollers so as to move the surface of the surface moving member at a substantially constant speed.

10. The image forming apparatus according to claim 4, wherein a plurality of the latent image carriers are arranged along the surface moving member, and wherein at least one of the plurality of the latent image carriers has a different circumferential length from the other ones thereof.

* * * * *